US012339018B2

(12) United States Patent
Oh et al.

(10) Patent No.: US 12,339,018 B2
(45) Date of Patent: Jun. 24, 2025

(54) SPRAYING DEVICE AND METHOD OF CONTROLLING THE SAME FOR IMPROVING THERMAL EFFICIENCY OF AIR CONDITIONER

(71) Applicant: Samsung Electronics Co., Ltd., Suwon-si (KR)

(72) Inventors: Jeongkyo Oh, Suwon-si (KR); Minji Kim, Suwon-si (KR); Sewon Kim, Suwon-si (KR); Hakjae Lee, Suwon-si (KR); Jaeyoun Cho, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 18/404,480

(22) Filed: Jan. 4, 2024

(65) Prior Publication Data

US 2024/0219041 A1 Jul. 4, 2024

Related U.S. Application Data

(63) Continuation of application No. PCT/KR2024/000136, filed on Jan. 3, 2024.

(30) Foreign Application Priority Data

Jan. 4, 2023 (KR) ..... 10-2023-0001319

(51) Int. Cl.
*F24F 1/42* (2011.01)
*F24F 140/30* (2018.01)

(52) U.S. Cl.
CPC ..... *F24F 1/42* (2013.01); *F24F 2140/30* (2018.01)

(58) Field of Classification Search
CPC . B08B 3/024; F24F 13/222; F24F 1/42; F24F 2140/30
See application file for complete search history.

(56) References Cited

U.S. PATENT DOCUMENTS 8,991,203 B2 3/2015 Okabe et al.
10,894,274 B1 * 1/2021 Al-Shayea ..... F24F 13/222
2020/0370776 A1 * 11/2020 Ramirez ..... F24F 11/65

FOREIGN PATENT DOCUMENTS

JP 2003-185190 A 7/2003
JP 2008-196804 A 8/2008
(Continued)

OTHER PUBLICATIONS

International Search Report and Written Opinion dated Apr. 5, 2024 for International Application No. PCT/KR2024/000136.

*Primary Examiner* — Lionel Nouketcha
(74) *Attorney, Agent, or Firm* — STAAS & HALSEY LLP

(57) ABSTRACT

A spraying device, for spraying water onto an outdoor device of an air conditioner, including a water tank to store water, a first water level sensor to detect the water at a first water level, a second water level sensor to detect the water at a second water level, a nozzle to spray the water onto the outdoor device, and at least one processor configured to perform control to: with the stored water not being sprayed: start spraying the water onto the outdoor device, based on the water being detected at the first water level by the first water level sensor and the water being detected at the second water level by the second water level sensor, and with the stored water being sprayed: stop spraying the water onto the outdoor device, based on the water not being detected at the second water level by the second water level sensor.

20 Claims, 15 Drawing Sheets

(56) References Cited

FOREIGN PATENT DOCUMENTS

| | | | | |
|---|---|---|---|---|
| JP | 2010-14346 | | | 1/2010 |
| JP | 2011-33245 | A | | 2/2011 |
| JP | 2011033245 | A | * | 2/2011 |
| JP | 2011-047601 | | | 3/2011 |
| JP | 2011-69589 | | | 4/2011 |
| JP | 4794698 | B2 | | 10/2011 |
| JP | 2013-119992 | A | | 6/2013 |
| JP | 2014-224646 | | | 12/2014 |
| JP | 6286286 | B2 | | 2/2018 |
| JP | 6820635 | B1 | | 1/2021 |
| KR | 10-0454052 | B1 | | 10/2004 |
| KR | 10-2005-0052739 | B1 | | 6/2005 |
| KR | 10-1346153 | B1 | | 1/2014 |
| KR | 10-2018-0109591 | | | 10/2018 |
| KR | 10-2019-0106560 | A | | 9/2019 |
| KR | 10-2214539 | B1 | | 2/2021 |
| KR | 10-2224193 | B1 | | 3/2021 |
| KR | 10-2023-0046062 | | | 4/2023 |

* cited by examiner

FIG. 6

<COMPARISON OF SPRAY CHARACTERISTICS BY NOZZLE TYPE>

| SPRAY CHARACTERISTICS \ NOZZLE TYPE | | TWO-FLUID NOZZLE | FINE SPRAY (SINGLE-FLUID NOZZLE) | HOLLOW CONE (SINGLE-FLUID NOZZLE) | FULL CONE (SINGLE-FLUID NOZZLE) |
|---|---|---|---|---|---|
| 0.7 bar (10 psi) | CAPACITY l/min | 0.2 ~ 0.8 | 0.83 | 0.19 ~ 45 | 0.38 ~ 45 |
| | VMD μm | 20 ~ 100 | 375 | 360 ~ 3400 | 1140 ~ 4300 |
| | SPRAY PATTERN | | | | |

SPRAYING DEVICE AND METHOD OF CONTROLLING THE SAME FOR IMPROVING THERMAL EFFICIENCY OF AIR CONDITIONER

CROSS-REFERENCE TO RELATED APPLICATIONS

This is a continuation application of International Application No. PCT/KR2024/000136, filed Jan. 3, 2024, which is incorporated herein by reference in its entirety, it being further noted that foreign priority benefit is based upon Korean Patent Application No. 10-2023-0001319, filed Jan. 4, 2023, which is incorporated by reference herein in its entirety.

TECHNICAL FIELD

Embodiments of the disclosure provide a spraying device and method of controlling the same for improving the thermal efficiency of an air conditioner. An embodiment of the disclosure provides a spraying device coupled to or built into an outdoor device of an air conditioner. Furthermore, embodiments of the disclosure provide a method of controlling a spraying device and a computer-readable recording medium having recorded thereon a program for performing, on a computer, the method of controlling the spraying device.

BACKGROUND ART

An air conditioner includes an indoor device and an outdoor device. The outdoor device of the air conditioner uses an air cooling method that uses wind from a fan to lower a temperature of a heat exchanger of the outdoor device. The air cooling method promotes convection and radiation that are the transfer of heat from the heat exchanger. However, when heat exchange does not occur properly due to insufficient heat exchange capacity of the outdoor device, cooling efficiency of the air conditioner decreases, and energy efficiency thereof decreases. When the cooling efficiency of the outdoor device decreases, the amount of carbon dioxide produced increases, and a discharge temperature of the outdoor device of the air conditioner increases, thereby accelerating global warming. Therefore, a device and method for improving the heat exchange efficiency of an outdoor device are required.

DISCLOSURE

Technical Solution

According to an aspect of the disclosure, there is provided a spraying device for spraying water onto an outdoor device of an air conditioner. The spraying device may include a water tank configured to store water. Furthermore, the spraying device may include a first water level sensor configured to detect the stored water at a first water level of the water tank. Furthermore, the spraying device may include a second water level sensor configured to detect the stored water at a second water level of the water tank that is lower than the first water level of the water tank. Furthermore, the spraying device may include a nozzle configured to spray the stored water onto the outdoor device. Furthermore, the spraying device includes a memory storing at least one instruction. Furthermore, the spraying device may include at least one processor. The at least one processor may be configured to execute the at least one instruction to with the stored water not being sprayed onto the outdoor device: start spraying the stored water onto the outdoor device, based on the stored water being detected at the first water level of the water tank by the first water level sensor and the stored water being detected at the second water level of the water tank by the second water level sensor. Furthermore, the at least one processor may be configured to perform control to with the stored water being sprayed onto the outdoor device: stop spraying the stored water onto the outdoor device, based on the stored water not being detected at the second water level of the water tank by the second water level sensor.

According to an aspect of the disclosure, the at least one processor may be further configured to execute the at least one instruction to: obtain a value of a supply current supplied to the outdoor device, and the start of spraying may start spraying based on the value of the supply current being greater than or equal to a first reference current value and based on the stored water being detected at the first water level of the water tank by the first water level sensor and the stored water being detected at the second water level of the water tank by the second water level sensor.

According to an aspect of the disclosure, the at least one processor may be further configured to execute the at least one instruction to stop spraying based on the value of the supply current being less than the first reference current value.

According to an aspect of the disclosure, the spraying device may further include a drain valve configured to drain the stored water from the water tank. Furthermore, the at least one processor may be further configured to execute the at least one instruction to: open the drain valve to drain the stored water from the water tank based on a reference drainage time having elapsed since the stopping of the spraying.

According to an aspect of the disclosure, the at least one processor may be further configured to execute the at least one instruction to: close the drain valve based on a reference standby time having elapsed since the opening the drain valve and the value of the supply current being greater than or equal to a second reference current value, and the second reference current value may correspond to the value of the supply current during an initial operation of the air conditioner in which the air conditioner starts operating.

According to an aspect of the disclosure, the spraying device may further include a current sensor configured to measure the value of the supply current supplied to the outdoor device. Furthermore, the obtained value may correspond to the value of the supply current measured by the current sensor.

According to an aspect of the disclosure, the spraying device may further include a communication module configured to communicate with the outdoor device. Furthermore, the value of the supply current may be obtained from the outdoor device via the communication module.

According to an aspect of the disclosure, the spraying device may further include a water supply valve configured to open and close to open and close, respectively, a supply of the stored water to the nozzle. Furthermore, the at least one processor may be further configured to execute the at least one instruction to: open the water supply valve to start the spraying of the stored water onto the outdoor device, and close the water supply valve to stop the spraying of the stored water onto the outdoor device.

According to an aspect of the disclosure, the spraying device may further include an air pump configured to inject air into the nozzle. Furthermore, the at least one processor may be further configured to execute the at least one instruction to: with the water supply valve being open: control the air pump to inject air into the nozzle.

According to an aspect of the disclosure, the at least one processor may be further configured to execute the at least one instruction to: with the water supply valve being closed: control the air pump to inject air into the nozzle for a first reference time after the water supply valve is closed, and when the first reference time has elapsed since the water supply valve is closed, control the air pump to stop injecting air into the nozzle.

According to an aspect of the disclosure, the water tank may include a water inlet configured to receive condensate water from an indoor device of the air conditioner.

According to an aspect of the disclosure, the spraying device may further include a step motor configured to rotate the nozzle. Furthermore, the at least one processor may be further configured to execute the at least one instruction to: control the step motor to rotate the nozzle.

According to an aspect of the disclosure, the water tank may include a first stage and a second stage having a lower surface lower than a first stage lower surface and a drain hole configured to drain the stored water into the nozzle. Furthermore, the second stage may include a narrower and deeper shape than the first stage. Furthermore, the first water level sensor may be configured to detect the stored water at the first water level of the water tank in the first stage. Furthermore, the second water level sensor may be configured to detect the stored water at the second water level of the water tank in the second stage.

Further, according to an aspect of the disclosure, there is provided a method of controlling a spraying device for spraying water onto an outdoor device of an air conditioner. The method of controlling the spraying device may include detecting stored water at a first water level of a water tank of the spraying device by using a first water level sensor. Furthermore, the method of controlling the spraying device may include detecting the stored water at a second water level of the water tank that is lower than the first water level of the water tank by using a second water level sensor. Furthermore, the method of controlling the spraying device may include, with the stored water not being sprayed onto the outdoor device: starting spraying the stored water onto the outdoor device, based on the stored water being detected at the first water level of the water tank by the first water level sensor and the stored water being detected at the second water level of the water tank by the second water level sensor. Furthermore, the method of controlling the spraying device may include stopping spraying the stored water onto the outdoor device, based on the stored water not being detected at the second water level of the water tank by the second water level sensor.

According to an aspect of the disclosure, the method of controlling the spraying device may include obtaining a value of a supply current supplied to the outdoor device. Furthermore, the starting spraying may include starting spraying based on the value of the supply current being greater than or equal to a first reference current value and based on the stored water being detected at the first water level of the water tank by the first water level sensor and the stored water being detected at the second water level of the water tank by the second water level sensor.

According to an aspect of the disclosure, the stopping spraying may include stopping spraying based on the value of the supply current being less than the first reference current value.

According to an aspect of the disclosure, the method of controlling the spraying device may include opening a drain valve of the spraying device to drain the stored water from the water tank, based on a reference drainage time having elapsed since the stopping spraying.

According to an aspect of the disclosure, the method of controlling the spraying device may include closing the drain valve of the spraying device to stop draining the stored water from the water tank, based on a reference standby time having elapsed since the opening the drain valve and the value of the supply current being greater than or equal to a second reference current value. Furthermore, the second reference current value may correspond to the value of the supply current during an initial operation of the air conditioner in which the air conditioner starts operating.

According to an aspect of the disclosure, the method of controlling the spraying device may include opening a water supply valve, which is configured to open and close to open and close, respectively, a supply of stored water to a nozzle configured spray the stored water onto the outdoor device, to start the spraying of the stored water onto the outdoor device; and closing the water supply valve to stop the spraying of the stored water onto the outdoor device.

According to an aspect of the disclosure, there is provided a computer-readable recording medium having recorded thereon a program for performing, on a computer, a method of controlling a spraying device.

DESCRIPTION OF DRAWINGS

FIG. 6 is a diagram illustrating operations of nozzles according to an embodiment of the disclosure.

MODE FOR INVENTION

Figure 1:
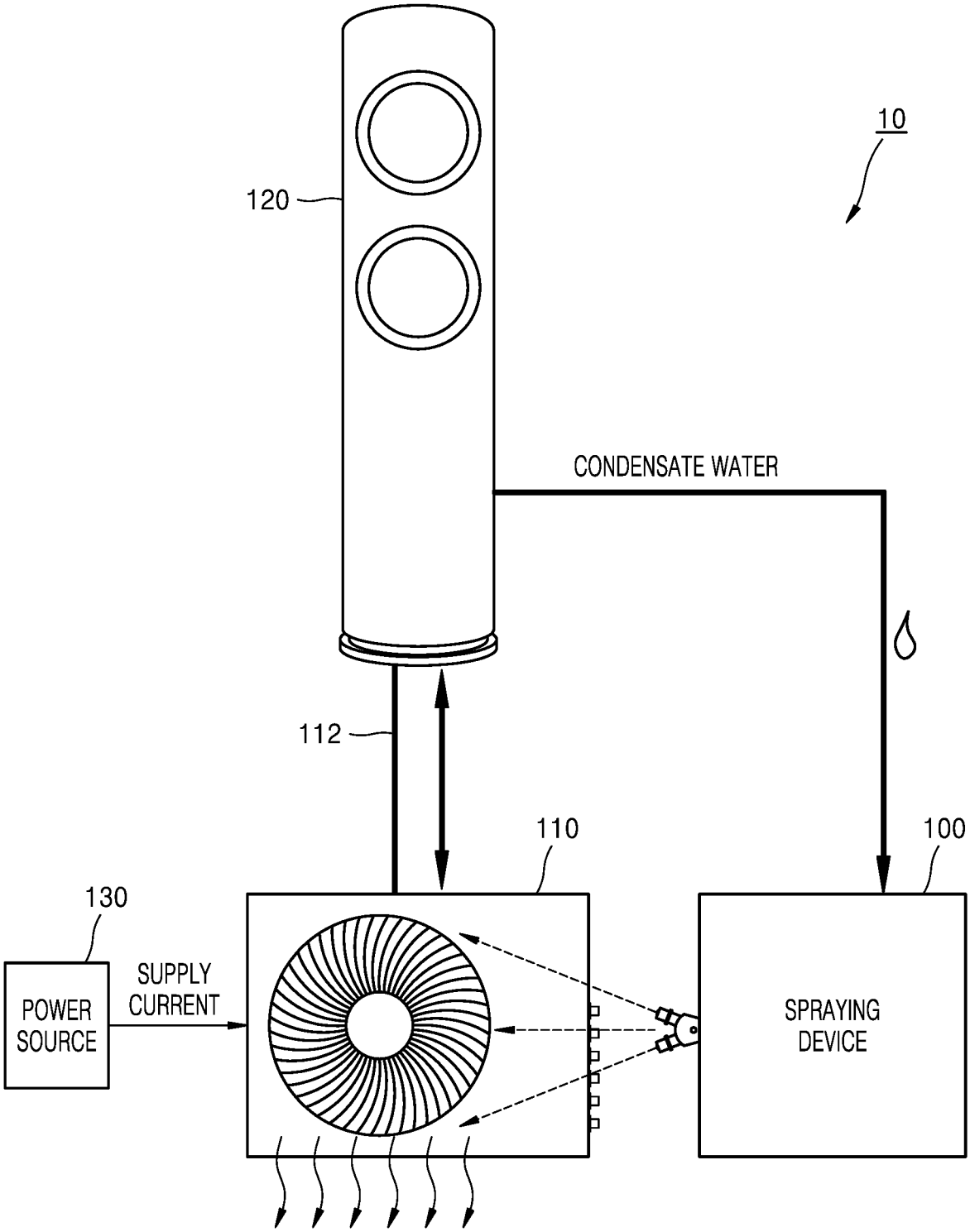
FIG. 1 is a diagram illustrating an air conditioner according to an embodiment of the disclosure.

It should be understood that various embodiments of the disclosure in this document and terms used therein are not intended to limit the technical features described herein to particular embodiments of the disclosure and that the disclosure includes various modifications, equivalents, or substitutions of the embodiments of the disclosure.

With regard to the description of the drawings, like reference numerals may be used to represent like or related elements.

A singular form of a noun corresponding to an item may include one or a plurality of the items unless the context clearly indicates otherwise.

As used herein, each of the phrases such as "A or B," "at least one of A and B, "at least one of A or B," "A, B, or C," "at least one of A, B, and C," and "at least one of A, B, or C" may include any one of the items listed together in a corresponding one of the phrases, or all possible combinations thereof.

The term "and/or" includes any combination of a plurality of associated elements listed, or any one of the plurality of associated listed elements.

Terms such as "first," "second," etc. may be used simply to distinguish an element from other elements and do not limit the elements in any other respect (e.g., importance or order).

It will be understood that when an element (e.g., a first element) is referred to, with or without the term "functionally" or "communicatively", as being "coupled" or "connected" to another element (e.g., a second element), the element may be coupled to the other element directly (e.g., in a wired manner), wirelessly, or via a third element.

The terms such as "comprise," "include," or "have" are intended to specify the presence of stated features, numbers, steps, operations, elements, components, or combinations thereof, but do not preclude the presence or addition of one or more other features, numbers, steps, operations, elements, components, or combinations thereof.

It will also be understood that when an element is referred to as being "connected," "coupled," "supported," or "in contact" with another element, this includes not only when the elements are directly connected, coupled, supported, or in contact, but also when they are indirectly connected, coupled, supported, or in contact via a third element.

It will also be understood that when an element is referred to as being "on" another element, the element may be directly on the other element, or intervening elements may also be present therebetween.

An air conditioner according to various embodiments of the disclosure is an apparatus that performs functions such as air purification, ventilation, humidity control, cooling, or heating in an air-conditioned space (hereinafter referred to as an ":indoor space") and is equipped with at least one of these functions.

According to an embodiment of the disclosure, the air conditioner may include a heat pump system to perform a cooling function or a heating function. The heat pump system may include a refrigeration cycle in which a refrigerant is circulated through a compressor, a first heat exchanger, an expansion device, and a second heat exchanger. All components of a heat pump system may be built into a single housing that forms an external appearance of an air conditioner, and window-type air conditioners or portable air conditioners are examples of such an air conditioner. On the other hand, components of the heat pump system may be split into several parts and built into a plurality of housings that form a single air conditioner, and examples of such an air conditioner include wall-mounted air conditioners, stand-type air conditioners, and system air conditioners.

An air conditioner including a plurality of housings may include at least one outdoor device installed outdoors and at least one indoor device installed indoors. For example, an air conditioner may be equipped with one outdoor device and one indoor device connected via a refrigerant pipe. For example, an air conditioner may include one outdoor device and two or more indoor devices connected via a refrigerant pipe. For example, an air conditioner may include two or more outdoor devices and two or more indoor devices connected via a plurality of refrigerant pipes.

An outdoor device may be electrically connected to an indoor device. For example, information (or commands) for controlling an air conditioner may be input via an input interface provided on the outdoor or indoor device, and the outdoor device and the indoor device may operate simultaneously or sequentially in response to a user input.

The air conditioner may include an outdoor heat exchanger provided in the outdoor device, an indoor heat exchanger provided in the indoor device, and a refrigerant pipe connecting the outdoor heat exchanger to the indoor heat exchanger.

An outdoor heat exchanger may exchange heat between a refrigerant and outdoor air by using a phase change (e.g., evaporation or condensation) of the refrigerant. For example, the refrigerant may release heat into the outdoor air during condensation of the refrigerant in the outside heat exchanger, and the refrigerant may absorb heat from the outdoor air during evaporation of the refrigerant flowing in the outside heat exchanger.

An indoor device is installed indoors. For example, indoor devices may be classified into ceiling-mounted indoor devices, stand-type indoor devices, wall-mounted indoor devices, etc., depending on how they are arranged. For example, ceiling-mounted indoor devices may be subdivided into 4-way cassette indoor devices, 1-way cassette indoor devices, duct-type indoor devices, etc. depending on a way air is discharged.

Similarly, an indoor heat exchanger may exchange heat between a refrigerant and indoor air by using a phase change (e.g., evaporation or condensation) of the refrigerant. For example, while the refrigerant evaporates in the indoor device, the refrigerant may absorb heat from the indoor air, and the indoor air is cooled as it passes through the cold indoor heat exchanger and then blown out to cool the indoor space. Furthermore, while a refrigerant condenses in the indoor heat exchanger, the refrigerant may release heat into the indoor air, and the indoor air is heated as it passes through the high-temperature indoor heat exchanger and then blown out to heat the indoor space.

That is, the air conditioner performs a cooling or heating function through a phase change process undergone by the refrigerant circulating between the outdoor heat exchanger and the indoor heat exchanger, and for this circulation of the refrigerant, the air conditioner may include a compressor that compresses the refrigerant. The compressor may suck in refrigerant gas through a suction port and compress the refrigerant gas. The compressor may discharge high-temperature, high-pressure refrigerant gas via a discharge port. The compressor may be placed inside the outdoor device.

The refrigerant may circulate, via a refrigerant pipe, through the compressor, the outdoor heat exchanger, the expansion device, and the indoor heat exchanger in the stated order, or through the compressor, the indoor heat exchanger, the expansion device, and the outdoor heat exchanger in the stated order.

For example, when the air conditioner has one outdoor device and one indoor device directly connected via a refrigerant pipe, the refrigerant may circulate between the one outdoor device and the one indoor device through the refrigerant pipe.

For example, when the air conditioner has one outdoor device connected to two or more indoor devices via a refrigerant pipe, refrigerants may flow into the plurality of indoor devices via refrigerant pipes branching from the outdoor device. The refrigerants discharged from the plurality of indoor devices may be combined together and circulated in the outdoor device. For example, the plurality of indoor devices may each be directly connected to the one outdoor device in parallel via separate refrigerant pipes.

Each of the plurality of indoor devices may operate independently according to an operating mode set by a user. That is, some of the plurality of indoor devices may operate in a cooling mode, and others may operate in a heating mode simultaneously. In this case, the refrigerant may be selectively introduced into each indoor device at a high or low pressure along a designated circulation path via a flow path diverter valve as described below, and then discharged from the indoor device and circulated to the outdoor device.

For example, when the air conditioner has two or more outdoor devices and two or more indoor devices connected via a plurality of refrigerant pipes, refrigerants discharged from the plurality of outdoor devices are combined and flow through a single refrigerant pipe, and then diverge again at a certain point to enter the plurality of indoor devices.

The plurality of outdoor devices may all be driven, or at least some of the outdoor devices may not be driven, depending on an operating load corresponding to the amount of operation of the plurality of indoor devices. In this case, the refrigerant may flow into and circulate in an outdoor device that is selectively driven via a flow path diverter valve. The air conditioner may include an expansion device to lower the pressure of the refrigerant entering a heat exchanger. For example, the expansion device may be placed inside an indoor device, inside an outdoor device, or both.

For example, the expansion device may lower the temperature and pressure of the refrigerant by using a throttling effect. The expansion device may include an orifice capable of reducing a cross-sectional area of a flow path. The temperature and pressure of the refrigerant that passes through the orifice may be lowered.

For example, the expansion device may be implemented as an electronic expansion valve capable of adjusting an opening ratio (a ratio of a cross-sectional area of a flow path in a valve in a partially open state to a cross-sectional area of a flow path in the valve in a fully open state). The amount of refrigerant passing through the expansion device may be controlled depending on the opening ratio of the electronic expansion valve.

The air conditioner may further include a flow path diverter valve provided on a refrigerant circulation flow path. The flow path diverter valve may include, for example, a 4-way valve. The flow path diverter valve may determine a path of circulation of the refrigerant depending on an operating mode of an indoor device (e.g., cooling operation or heating operation). The flow path diverter valve may be connected to the discharge port of the compressor.

The air conditioner may include an accumulator. The accumulator may be connected to the suction port of the compressor. Low-temperature, low-pressure refrigerant evaporated from an indoor heat exchanger or an outdoor heat exchanger may flow into the accumulator.

When a mixture of refrigerant liquid and refrigerant gas flows into the accumulator, the accumulator may separate the refrigerant liquid from the refrigerant gas and provide the refrigerant gas from which the refrigerant liquid has been separated to the compressor.

An outdoor fan may be provided in the vicinity of the outdoor heat exchanger. The outdoor fan may blow outdoor air into the outdoor heat exchanger to facilitate heat exchange between the refrigerant and the outdoor air.

An outdoor device of the air conditioner may include at least one sensor. For example, an outdoor device sensor may be provided as an environment sensor. An outdoor device sensor may be placed at any location on the inside or outside of the outdoor device. For example, outdoor device sensors may include, for example, a temperature sensor for detecting air temperature around the outdoor device, a humidity sensor for detecting humidity in the air around the outdoor device, a refrigerant temperature sensor for detecting a refrigerant temperature inside a refrigerant pipe passing through the outdoor device, or a refrigerant pressure sensor for detecting a refrigerant pressure inside the refrigerant pipe passing through the outdoor device.

The outdoor device of the air conditioner may include an outdoor device communication interface. The outdoor device communication interface may be provided to receive a control signal from an indoor device controller of the air conditioner, as described later. The outdoor device may control, based on a control signal received via the outdoor device communication interface, an operation of a compressor, an outdoor heat exchanger, an expansion device, a flow path diverter valve, an accumulator, or an outdoor fan. The outdoor device may transmit, via the outdoor device communication interface, a sensing value detected by an outdoor device sensor to the indoor device controller.

The indoor device of the air conditioner may include a housing, a blower that circulates air inside or outside the housing, and an indoor heat exchanger that exchanges heat with air flowing into the housing.

The housing may include an air inlet. Indoor air may be drawn into the housing via the air inlet.

The indoor device of the air conditioner may include a filter provided to filter out foreign substances from the air drawn into the housing via the air inlet.

The housing may include an air outlet. Air flowing inside the housing may be discharged from the housing via the air outlet.

The housing of the indoor device may include an airflow guide that guides a direction of air discharged through the air outlet. For example, the airflow guide may include a blade located on the air outlet. For example, the airflow guide may include an auxiliary fan for regulating an exhaust airflow. However, the disclosure is not limited thereto, and the airflow guide may be omitted.

Inside the housing of the indoor device, the indoor heat exchanger and the blower may be provided on a flow path connecting the air inlet and the air outlet.

The blower may include an indoor fan and a fan motor. For example, indoor fans may include an axial fan, a diagonal fan, a crossflow fan, and a centrifugal fan.

The indoor heat exchanger may be placed between the blower and the air outlet, or between the air inlet and the blower. The indoor heat exchanger may absorb heat from air drawn in through the air inlet or transfer heat to air drawn in through the air inlet. The indoor heat exchanger may include a heat exchange tube in which a refrigerant flows, and heat exchange fins that are in contact with the heat exchange tube to increase the heat transfer area.

The indoor device of the air conditioner may include a drain tray located below the indoor heat exchanger to collect condensate water generated in the indoor heat exchanger. The condensate water collected in the drain tray may be drained to the outside via a drain hose. The drain tray may be provided to support the indoor heat exchanger.

The indoor device of the air conditioner may include an input interface. The input interface may include any type of user input devices, including buttons, switches, touch screens, and/or touch pads. The user may directly input setting data (e.g., desired indoor temperature, operating mode settings for cooling/heating/dehumidification/air purification, outlet selection settings, and/or air volume settings) via the input interface.

The input interface may be connected to an external input device. For example, the input interface may be electrically connected to a wired remote controller. The wired remote controller may be installed at a specific location in an indoor space (e.g., a portion of a wall). The user may operate the wired remote controller to input setting data regarding an operation of the air conditioner. An electrical signal corresponding to setting data obtained via the wired remote controller may be transmitted to the input interface. In addition, the input interface may include an infrared sensor. The user may remotely input setting data regarding the operation of the air conditioner by using a wireless remote controller. The setting data input via the wireless remote controller may be transmitted to the input interface as an infrared signal.

Also, the input interface may include a microphone. A user's voice command may be obtained via the microphone. The microphone may convert the user's voice command into an electrical signal and transmit the electrical signal to the indoor device controller. The indoor device controller may control components of the air conditioner to perform a function corresponding to the user's voice command. Setting data (e.g., desired indoor temperature, operating mode settings for cooling/heating/dehumidification/air purification, outlet selection settings, and/or air volume settings) obtained via the input interface may be transmitted to the indoor device controller as described later. For example, the setting data obtained via the input interface may be transmitted to the outside, i.e., an outdoor device or a server, via an indoor device communication interface as described below.

The indoor device of the air conditioner may include a power module. The power module may be connected to an external power source to supply power to components of the indoor device.

The indoor device of the air conditioner may include an indoor device sensor. The indoor device sensor may be an environment sensor placed inside or outside the housing. For example, the indoor device sensor may include one or more temperature sensors and/or one or more humidity sensors arranged in a predetermined space inside or outside the housing of the indoor device. For example, the indoor device sensor may include a refrigerant temperature sensor for detecting a refrigerant temperature inside a refrigerant pipe passing through the indoor device. For example, the indoor device sensor may include refrigerant temperature sensors that respectively detect temperatures at an inlet, a middle, and/or an outlet of the refrigerant pipe passing through the indoor heat exchanger.

For example, pieces of environment information respectively detected by the indoor device sensors may be transmitted to the indoor device controller as described below, or may be transmitted to the outside via the indoor device communication interface as described below.

The indoor device of the air conditioner may include the indoor device communication interface. The indoor device communication interface may include at least one of a short-range communication module or a long-range communication module. The indoor device communication interface may include at least one antenna for wirelessly communicating with other devices. The outdoor device may include the outdoor device communication interface. The outdoor device communication interface may also include at least one of a short-range communication module or a long-range communication module.

The short-range communication module may include, but is not limited to, a Bluetooth communication module, a Bluetooth Low Energy (BLE) communication module, a near field communication (NFC) communication module, a wireless local area network (WLAN) (Wi-Fi) communication module, a ZigBee communication module, an Infrared Data Association (IrDA) communication module, a Wi-Fi Direct (WFD) communication module, an ultra-wideband (UWB) communication module, an Ant+ communication module, a microwave (uWave) communication module, etc.

The long-range communication module may include a communication module that performs various types of long-range communications, and include a mobile communication interface. The mobile communication interface transmits or receives a wireless signal to or from at least one of a base station, an external terminal, or a server on a mobile communication network.

The indoor device communication interface may communicate with an external device such as a server, a mobile device, or another home appliance via a nearby access point (AP). The AP may connect a LAN to which the air conditioner or a user device is connected to a wide area network (WAN) to which a server is connected. The air conditioner or user device may be connected to the server via the WAN. The indoor device of the air conditioner may include the indoor device controller that controls the components of the indoor device, including the blower. The outdoor device of the air conditioner may include an outdoor device controller that controls components of the outdoor device, including a compressor. The indoor device controller may communicate with the outdoor device controller via the indoor device communication interface and the outdoor device communication interface. The outdoor device communication interface may transmit a control signal generated by the outdoor device controller to the indoor device communication interface, or may transmit, to the outdoor device controller, a control signal transmitted from the indoor device communication interface. In other words, the outdoor device and the indoor device may communicate in both directions. The outdoor device and the indoor device may transmit and receive various signals generated during an operation of the air conditioner.

The outdoor device controller may be electrically connected to the components of the outdoor device and control an operation of each component. For example, the outdoor device controller may adjust a frequency of the compressor and control a flow path diverter valve to change a circulation direction of a refrigerant. The outdoor device controller may adjust a rotation speed of the outdoor fan. In addition, the outdoor device controller may generate a control signal for adjusting the degree of opening of an expansion valve. Under the control of the outdoor device controller, the refrigerant may circulate along a refrigerant circulation circuit including the compressor, the flow path diverter valve, the outdoor heat exchanger, the expansion valve, and the indoor heat exchanger.

Various temperature sensors included in the outdoor device and the indoor device may each transmit an electrical signal corresponding to a temperature detected by each of the temperature sensors (to the outdoor device controller and/or the indoor device controller. For example, each of humidity sensors included in the outdoor device and the indoor device may transmit an electrical signal corresponding to its detected humidity to the outdoor device controller and/or the indoor device controller.

The indoor device controller may obtain a user input from a user device including a mobile device or the like via the indoor device communication interface, and obtain a user input directly via the input interface or through a remote controller. The indoor device controller may control the components of the indoor device, including the blower, etc., in response to the received user input. The indoor device controller may transmit information about the received user input to the outdoor device controller of the outdoor device.

The outdoor device controller may control the components of the outdoor device, including the compressor, etc., based on information about a user input received from the indoor device. For example, when a control signal corresponding to a user input for selecting an operating mode such as cooling operation, heating operation, blowing operation, defrosting operation, or dehumidifying operation is received from the indoor device, the outdoor device controller may control the components of the outdoor device to perform an operation of the air conditioner, corresponding to the selected operating mode.

The outdoor device controller and the indoor device controller may each include a processor and memory. The indoor device controller may include at least one first processor and at least one first memory, and the outdoor device controller may include at least one second processor and at least one second memory.

The memory may record/store various pieces of information necessary for operations of the air conditioner. The memory may store instructions, applications, data, and/or programs necessary for operations of the air conditioner. For example, the memory may store various programs for cooling operation, heating operation, dehumidifying operation, and/or defrosting operation of the air conditioner. The memory may include volatile memories, such as static random access memory (SRAM) and dynamic RAM (DRAM), for temporarily storing data. Furthermore, the memory may include non-volatile memories for long-term storage of data, such as read-only memory (ROM), erasable programmable ROM (EPROM), and electrically erasable PROM (EEPROM).

The processor may generate control signals for controlling operations of the air conditioner, based on instructions, applications, data, and/or programs stored in the memory. The processor is a hardware component and may include logic circuits and arithmetic circuits. The processor may process data according to programs and/or instructions provided from the memory and generate control signals based on processing results. The memory and processor may each be implemented as a single control circuit or as a plurality of circuits.

The indoor device of the air conditioner may include an output interface. The output interface is electrically connected to the indoor device controller and may output information related to an operation of the air conditioner under the control of the indoor device controller. For example, the output interface may output information such as operating mode, wind direction, air volume, and temperature selected by a user input. In addition, the output interface may output sensing information and warning/error messages obtained from the indoor device sensor or the outdoor device sensor.

The output interface may include a display and a speaker. The speaker is an audio device that may output a variety of sounds. The display may display information input by the user or information provided to the user by using various graphical elements. For example, operation information about the air conditioner may be displayed as at least one of an image or text. The display may also include indicators that provide specific information. The display may include a liquid crystal display (LCD) panel, a light emitting diode panel (LED) panel, an organic light emitting diode (OLED) panel, a micro LED panel, and/or a plurality of LEDs.

Hereinafter, air conditioners according to various embodiments of the disclosure will be described in detail with reference to the drawings.

FIG. 1 is a diagram illustrating an air conditioner according to an embodiment of the disclosure.

An air conditioner 10 according to an embodiment of the disclosure includes a spraying device 100, an outdoor device 110, and an indoor device 120.

According to various embodiments of the disclosure, to cool a space to be air-conditioned, the air conditioner 10 may absorb heat from the air-conditioning space (hereinafter referred to as "an indoor space") and release heat to the outside of the air-conditioning space (hereinafter referred to as "an outdoor space").

The air conditioner 10 may include one or more outdoor devices 110 installed outdoors and one or more indoor devices 120 installed indoors. The outdoor device 110 may be electrically connected to the indoor device 120. For example, a user may input information (or commands) for controlling the indoor device 120 via a user interface, and the outdoor device 110 may operate in response to the user input from the indoor device 120.

The outdoor device 110 is located outdoors. The outdoor device 110 may perform heat exchange between a refrigerant and outdoor air by using a phase change (e.g., expansion or compression) of the refrigerant. For example, while the refrigerant is compressed in the outdoor device 110, the refrigerant may release heat into the outdoor air. While the refrigerant expands in the outdoor device 110, the refrigerant may absorb heat from the outdoor air.

The indoor device 120 is located indoors. The indoor device 120 may be located indoors in various forms. For example, the indoor device 120 may be implemented in a floor standing form, a wall-mounted form, a ceiling mounted system air conditioner form, or a home multi-split air conditioner form. The indoor device 120 may perform heat exchange between a refrigerant and indoor air by using a phase change (e.g., expansion or compression) of the refrigerant. While the refrigerant expands in the indoor device 120, the refrigerant may absorb heat from the indoor air, and the indoor space may be cooled. While the refrigerant is compressed in the indoor device 120, the refrigerant may release heat into the indoor air, and the indoor space may be heated.

The outdoor device 110 may be fluidly coupled to the indoor device 120 through a refrigerant pipe 112. Refrigerant may be circulated between the outdoor device 110 and the indoor device 120 through the refrigerant pipe 112. The refrigerant circulates, via the refrigerant pipe 112, inside an indoor heat exchanger of the indoor device 120 and a compressor, an outdoor heat exchanger, and an expansion device of the outdoor device 110.

According to an embodiment of the disclosure, the spraying device 100 is mounted to or built into the outdoor device 110. The spraying device 100 sprays water onto an air-cooled outdoor heat exchanger, thereby increasing cooling efficiency of the outdoor heat exchanger due to the heat of vaporization that is the evaporation of moisture adhering to a surface of the heat exchanger. Additionally, the spraying device 100 may reduce electricity costs by increasing the cooling efficiency of the outdoor heat exchanger.

According to an embodiment of the disclosure, the spraying device 100, the outdoor device 110, and the indoor device 120 communicate with one another to transmit and receive status information, control information, etc. therebetween. The outdoor device 110 and the indoor device 120 may be connected using various communication methods, e.g., in a wired or wireless manner. According to an embodiment of the disclosure, the outdoor device 110 and the indoor device 120 may be connected using RS-485 serial communication. According to an embodiment of the disclosure, the spraying device 100 is connected to the outdoor device 110 and the indoor device 120 by using existing RS-485 serial communication used in the outdoor device 110 and the indoor device 120.

The spraying device 100 may communicate with the outdoor device 110 and the indoor device 120 to receive status information output from the outdoor device 110 and the indoor device 120. The spraying device 100 receives status information, such as compressor operating frequency and fan speed in revolution per minute (RPM), from the outdoor device 110.

According to an embodiment of the disclosure, the spraying device 100 stores water in a water tank and sprays the water stored in the water tank onto the outdoor device 110 by using a nozzle. The spraying device 100 controls a water spraying operation based on a water level in the water tank. According to an embodiment of the disclosure, the spraying device 100 includes two water level sensors in the water tank and controls a water spraying operation by using detection values from the two water level sensors. According to an embodiment of the disclosure, a water spraying operation of the spraying device 100 is controlled by using the detection values of the two water level sensors, thereby preventing excessive turning on/off of the spraying operation as the water level changes and efficiently controlling the after spraying operation.

Furthermore, according to an embodiment of the disclosure, the spraying device 100 controls a water spraying operation by using a value of supply current supplied to the outdoor device 110 from a power source 130. The spraying device 100 controls a water spraying operation by using a value of supply current for the outdoor device 110 and detection values from the water level sensors of the water tank, thereby preventing spraying of excessive water to the outdoor device 110.

In addition, according to an embodiment of the disclosure, the spraying device 100 may receive condensate water from the indoor device 120 and use it for spraying water. The spraying device 100 requires a water supply to spray water. When connecting a water pipe for such water supply, installation is difficult because construction work is required to connect the water pipe. According to an embodiment of the disclosure, the spraying device 100 receives condensate water via a pipe connected to the indoor device 120 to use it for water spraying, which allows easy installation without separate construction of a water pipe.

Figure 2:
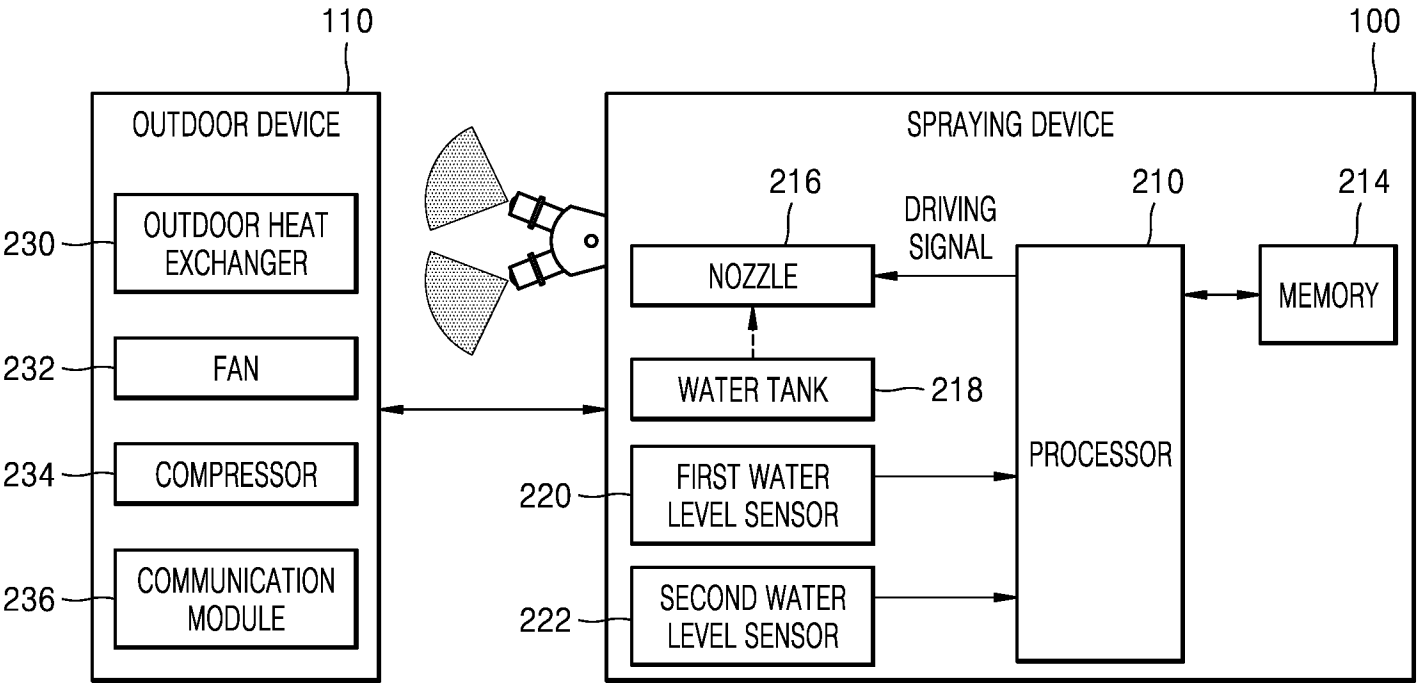
FIG. 2 is a block diagram illustrating structures of a spraying device and an outdoor device, according to an embodiment of the disclosure.

FIG. 2 is a block diagram illustrating structures of a spraying device and an outdoor device, according to an embodiment of the disclosure.

According to an embodiment of the disclosure, the spraying device 100 includes a processor 210, a memory 214, a nozzle 216, a water tank 218, a first water level sensor 220, and a second water level sensor 222.

The processor 210 controls all operations of the spraying device 100. The processor 210 may be implemented as one or more processors. The processor 210 may execute instructions or commands stored in the memory 214 to perform predetermined functions. Furthermore, the processor 210 controls operations of components included in the spraying device 100. The processor 210 may include a central processing unit (CPU), a microprocessor, etc.

The memory 214 stores various pieces of information, data, instructions, programs, etc. necessary for operations of the spraying device 100. The memory 214 may include at least one of volatile memory or non-volatile memory, or a combination thereof. The memory 214 may include at least one type of storage medium, i.e., at least one of a flash memory-type memory, a hard disk-type memory, a multimedia card micro-type memory, a card-type memory (e.g., an SD card or an XD memory), RAM, SRAM, ROM, EEPROM, PROM, a magnetic memory, a magnetic disc, or an optical disc. In addition, the memory 214 may correspond to a web storage or cloud server that performs a storage function on the Internet.

According to an embodiment of the disclosure, the spraying device 100 may include a microcomputer with the processor 210 and the memory 214 configured as a single chip.

The water tank 218 stores water. The water tank 218 may be implemented in the form of a predetermined container. The water tank 218 may have an inlet portion capable of supplying water and an outlet portion capable of draining water.

The nozzle 216 sprays water supplied from the water tank 218. The nozzle 216 includes at least one discharge orifice and sprays water through the discharge orifice. According to an embodiment of the disclosure, the nozzle 216 is connected to a step motor to spray water while rotating back and forth at a predetermined angle.

The first water level sensor 220 and the second water level sensor 222 are provided in the water tank 218. The first water level sensor 220 and the second water level sensor 222 each measure a level of the water stored in the water tank 218. The first water level sensor 220 detects water at a first water level. The second water level sensor 222 detects water at a second water level. The second water level is a water level lower than the first water level. When the water tank 218 stores water at the first water level or higher, water is detected by the first water level sensor 220. When the water tank 218 stores water at the second water level or higher, water is detected by the second water level sensor 222.

The first water level sensor 220 and the second water level sensor 222 may each be implemented in the form of a contact-type water level sensor. The first water level sensor 220 and the second water level sensor 222 may each include at least one of, for example, a float-type water level sensor, a guide rope-type water level sensor, a pressure-type water level sensor, or a capacitance-type water level sensor.

The processor 210 receives a detection value of the first water level sensor 220 and a detection value of the second water level sensor 222. The processor 210 controls a water spraying operation of the nozzle 216, based on the detection value of the first water level sensor 220 and the detection value of the second water level sensor 222. According to an embodiment of the disclosure, the processor 210 determines whether to start a water spraying operation and whether to stop the water spraying operation, based on the detection value of the first water level sensor 220 and the detection value of the second water level sensor 222.

The processor 210 may control opening and closing of a water supply valve C1, which controls the supply of water from the water tank 218 to the nozzle 216, in order to control whether the nozzle 216 is to perform a water spraying operation. The processor 210 may open the water supply valve C1 to start a water spraying operation, and close the water supply valve C1 to stop the water spraying operation.

In addition, the processor 210 may control operations of the water supply valve C1 and a step motor that rotates the nozzle 216 to control a water spraying time and a water spraying cycle.

The outdoor device 110 includes an outdoor heat exchanger 230, a fan 232, a compressor 234, and a communication module 236.

According to an embodiment of the disclosure, the spraying device 100 is coupled to a housing of the outdoor device 110. The spraying device 100 may be implemented in the form of an accessory that is combinable with the outdoor device 110. In this case, the spraying device 100 may be fixed onto an outer wall of the housing of the outdoor device 110 by a certain fixing member. The spraying device 100 may be coupled to the outdoor device 110 so that water sprayed from the nozzle 216 may be sprayed onto the outdoor heat exchanger 230. When the spraying device 100 is coupled to the outdoor device 110, the spraying device 100 may be connected to a predetermined communication terminal provided on the outdoor device 110 for RS-485 communication.

Furthermore, according to an embodiment of the disclosure, the spraying device 100 may be built inside the outdoor device 110. The spraying device 100 is provided inside the outdoor device 110 to spray water onto the outdoor heat exchanger 230 of the outdoor device 110.

The outdoor heat exchanger 230 may release heat through heat exchange between a refrigerant and outdoor air. For example, during cooling operation, high-pressure, high-temperature refrigerant is compressed in the outdoor heat exchanger 230, and while the refrigerant is compressed, the refrigerant may release heat to the outdoor air.

The fan 232 is located in the vicinity of the outdoor heat exchanger 230. The fan 232 may blow outdoor air into the outdoor heat exchanger 230 to facilitate heat exchange between the refrigerant and the outdoor air. The outdoor heat exchanger 230 may use an air cooling method using the fan 232.

The compressor 234 may compress a refrigerant gas. In the process of being compressed by the compressor 234, the refrigerant gas may be changed from a low temperature, low pressure state to a high temperature, high pressure state.

The communication module 236 communicates with the spraying device 100 and the indoor device 120 in a wired or wireless manner. According to an embodiment of the disclosure, the communication module 236 communicates with the spraying device 100 and the indoor device 120 by using RS-485 communication.

The spraying device 100 sprays water from the nozzle 216 onto the outdoor heat exchanger 230. The water sprayed onto the outdoor heat exchanger 230 hits a surface of the outdoor heat exchanger 230 to absorb heat therefrom, is sucked into the fan 232, and evaporates outside the outdoor device 110 along with the heat. The wind from the fan 232 promotes faster evaporation of the water sprayed onto the outdoor heat exchanger 230. As the water evaporates from the outdoor heat exchanger 230, the heat exchange efficiency of the outdoor device 110 increases.

Figure 3:
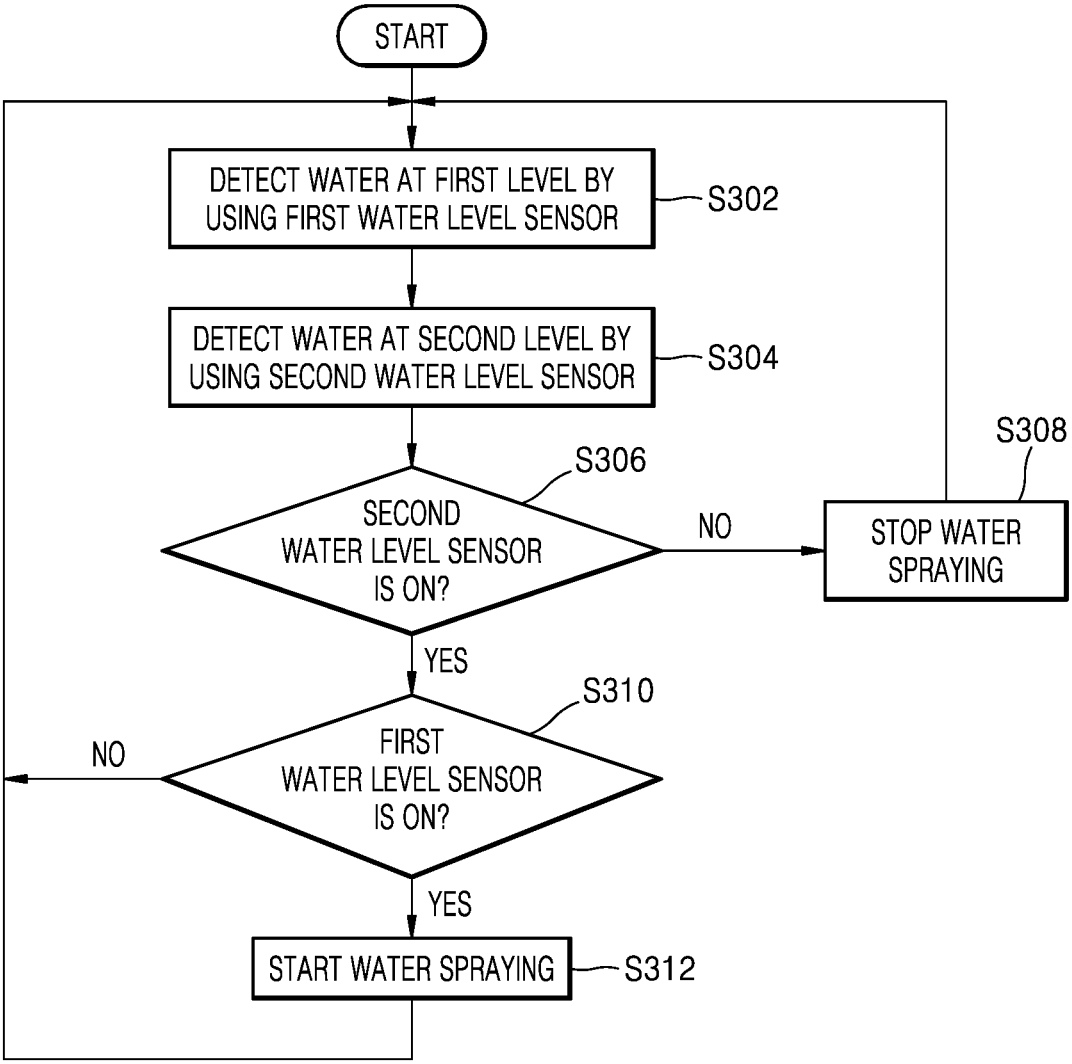
FIG. 3 is a flowchart of a method of controlling a spraying device according to an embodiment of the disclosure.

FIG. 3 is a flowchart of a method of controlling a spraying device, according to an embodiment of the disclosure.

The method of controlling the spraying device according to the embodiment of the disclosure may be performed by the spraying device 100 according to embodiments of the disclosure.

In operation S302, the spraying device 100 detects water at the first water level by using the first water level sensor 220. Additionally, in operation S304, the spraying device 100 detects water at the second water level by using the second water level sensor 222. The order of operation S302 and operation S304 is not limited to the order illustrated in FIG. 3. Operation S302 and operation S304 may be performed in parallel, or operation S304 may be performed first and then operation S302 may be performed. While power is applied to the spraying device 100, the first water level sensor 220 and the second water level sensor 222 may continuously or periodically detect water and respectively generate detection values.

In operation S306, the spraying device 100 determines whether water is detected by the second water level sensor 222. When a current that is greater than or equal to a reference value is detected by the second water level sensor 222, the spraying device 100 may determine that water is detected by the second water level sensor 222.

When the water is not detected by the second water level sensor 222, the spraying device 100 stops a water spraying operation in operation S308. When the spraying device 100 is performing a water spraying operation, the spraying device 100 stops the water spraying operation by closing the water supply valve C1 in operation S308. When the spraying device 100 is not performing the water spraying operation, the spraying device 100 maintains the water supply valve C1 in a closed state in operation S308.

When the water is detected by the second water level sensor 222, in operation S310, the spraying device 100 determines whether water is detected by the first water level sensor 220. When a current that is greater than or equal to a reference value is detected by the first water level sensor 220, the spraying device 100 may determine that water is detected by the first water level sensor 220.

When the water is not detected by the first water level sensor 220, the spraying device 100 detects water at the first water level by using the first water level sensor 220 in operation S302, detects water at the second water level by using the second water level sensor 222 in operation S304, and repeats the operation of determining whether to spray water.

When the water is detected by the first water level sensor 220, the spraying device 100 starts the water spraying operation in operation S312. When the spraying device 100 is not currently performing the water spraying operation, the spraying device changes the water supply valve C1 to an open state and starts the water spraying operation. When the spraying device 100 is currently performing the water spraying operation, the spraying device 100 maintains the open state of the water supply valve C1 to perform the water spraying operation.

After operation S312, the spraying device 100 detects water at the first water level by using the first water level sensor 220 in operation S302, detects water at the second water level by using the second water level sensor 222 in operation S304, and repeats the operation of determining whether to spray water.

According to an embodiment of the disclosure, a starting condition for the water spraying operation is defined as when water is detected by both the first water level sensor 220 and the second water level sensor 222. Even in a case where water is not detected by the first water level sensor 220 after starting the water spraying operation, the water spraying operation is not stopped when the water is detected by the second water level sensor 222. That is, after the water spraying operation is started, when there is only water in the water tank 218 at or above the second water level that is lower than the first water level, the water spraying operation continues to be performed. However, in a state where the water spraying operation is not started, the water spraying operation is started only when water at the first water level or higher is stored in the water tank 218, whereas the water spraying operation is not started even when a water level in the water tank 218 is higher than the second water level but is lower than the first water level. According to an embodiment of the disclosure, a condition for starting a water spraying operation and a condition for maintaining the water spraying operation are set differently by using two water level sensors, so that the water spraying operation is not started when there is insufficient water, but is maintained when the water level is higher than or equal to a minimum water level, thereby preventing the water spraying operation from being turned on/off unnecessarily.

Figure 4:
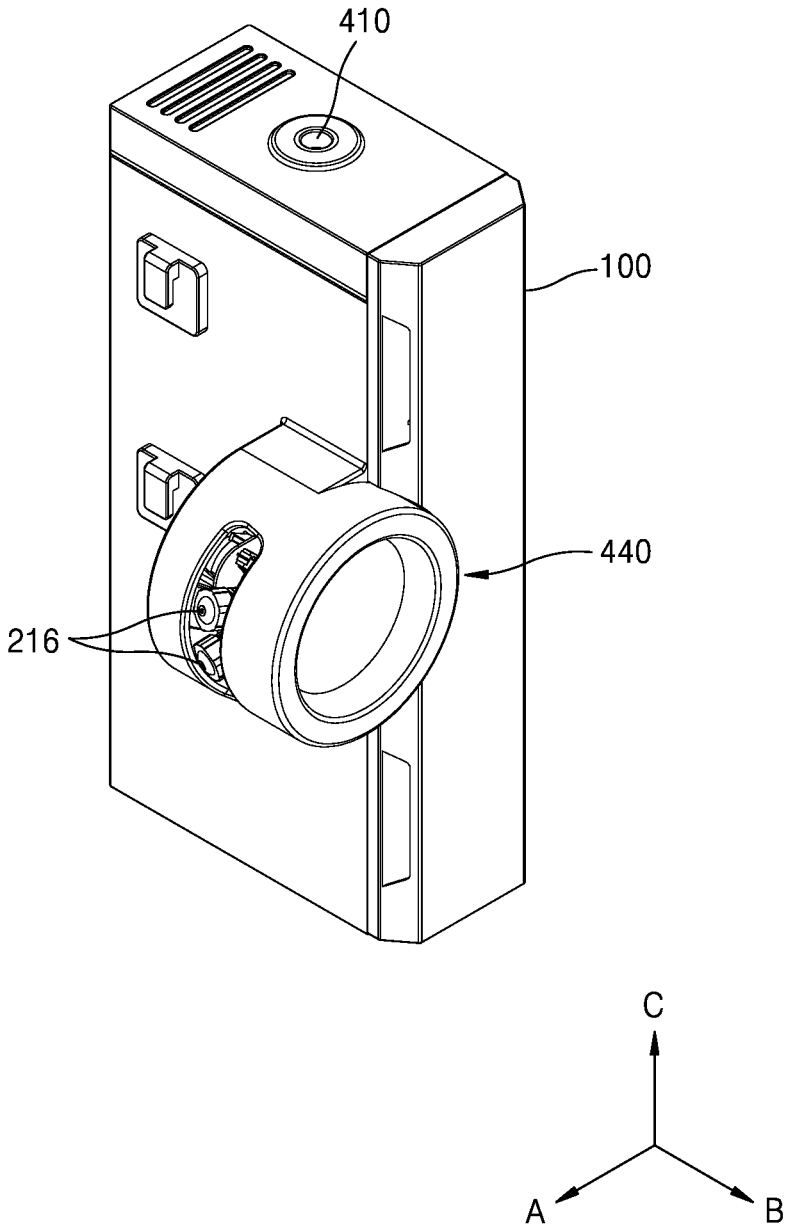
FIG. 4 is a perspective view of a spraying device according to an embodiment of the disclosure.

FIG. 4 is a perspective view of a spraying device according to an embodiment of the disclosure.

Figure 5:
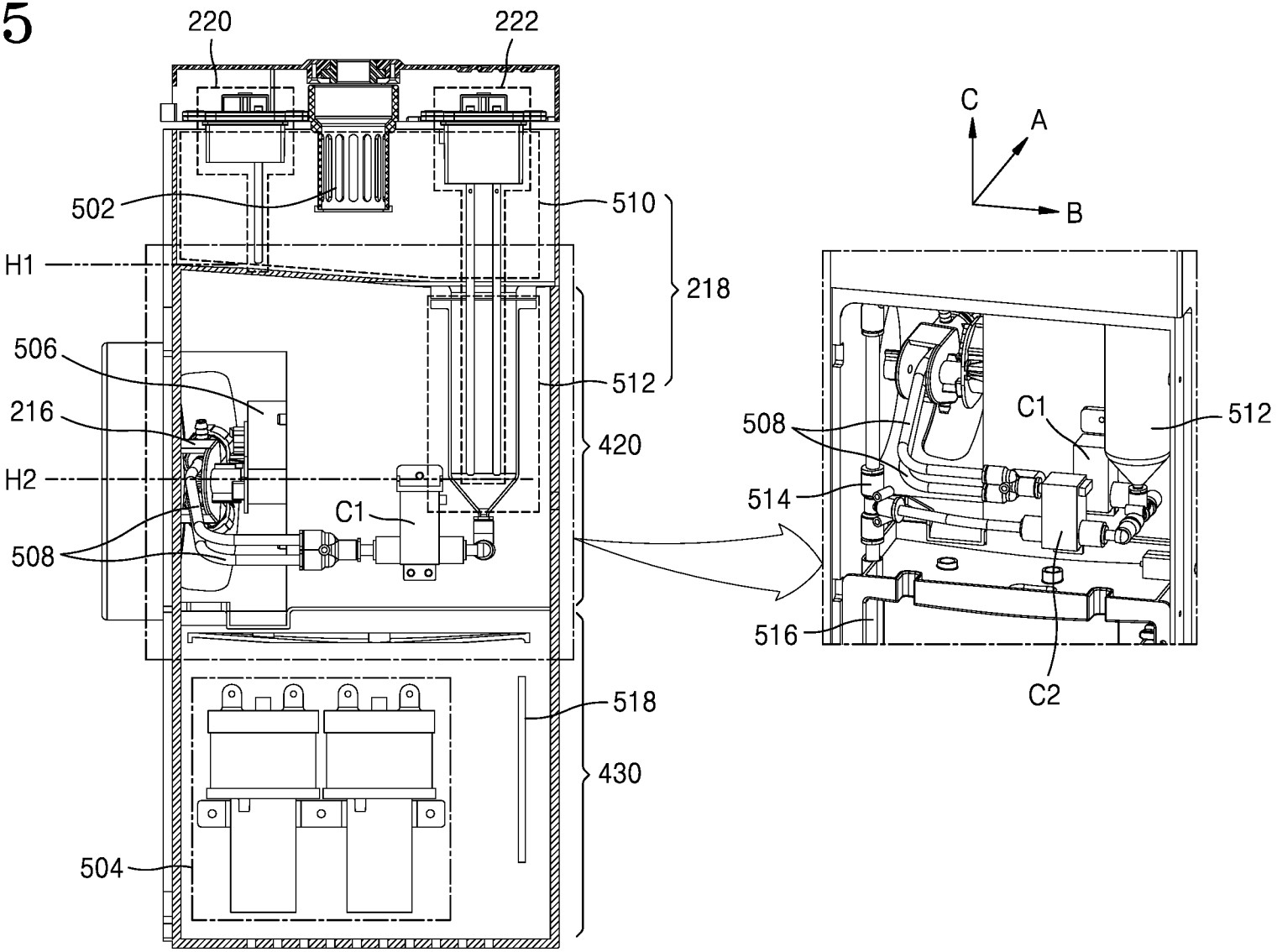
FIG. 5 is a cross-sectional view of a spraying device according to an embodiment of the disclosure.

FIG. 5 is a cross-sectional view of a spraying device according to an embodiment of the disclosure. The cross-sectional view of FIG. 5 is a cross-sectional view showing a cross-section BC of the spraying device 100 of FIG. 4 viewed in direction A.

A structure of the spraying device 100 is described with reference to FIGS. 4 and 5.

According to an embodiment of the disclosure, the spraying device 100 includes a water inlet 410, the water tank 218, a distributor 420, a machine room 430, and a discharge portion 440.

The water inlet 410 delivers water supplied from the outside to the water tank 218. The water inlet 410 may have an opening and have a coupling structure with a water inlet hose. The water inlet 410 may be placed at the top of the water tank 218. According to an embodiment of the disclosure, the water inlet 410 may be connected to the indoor device 120 via a hose to receive condensate water from the indoor device 120. According to an embodiment of the disclosure, the water inlet 410 may be connected to a water supply via the hose to receive water from the water supply.

The water tank 218 stores water supplied through the water inlet 410. The water tank 218 includes a container for storing water. The water tank 218 may be formed of, for example, a transparent or semi-transparent material. By constructing the water tank 218 from a transparent or semi-transparent material, the user may visually check the amount of water remaining in the water tank 218 from the outside.

According to an embodiment of the disclosure, the water tank 218 may include a filter 502, the first water level sensor 220, and the second water level sensor 222 therein. The filter 502 filters water supplied through the water inlet 410. The filter 502 removes foreign substances from the water supplied through the water inlet 410 to thereby control quality of the water stored in the water tank 218. The first water level sensor 220 and the second water level sensor 222 each measure a water level in the water tank 218. The first water level sensor 220 and the second water level sensor 222 respectively output detection values to the processor 210.

The water tank 218 includes a first stage storage 510 and a second stage storage 512. The second stage storage 512 is located below the first stage storage 510. The second stage storage 512 may have a vertically extending cylindrical structure. The first stage storage 510 may accommodate a filter 502. The second stage storage 512 is connected to a distribution pipe 520 through which water is drained from the water tank 218.

The first water level sensor 220 is arranged to measure a level of water in the first stage storage 510. The first water level sensor 220 is arranged to measure a water level near a lowest water level in the first stage storage 510. The second water level sensor 222 is arranged to measure a level of water in the second stage storage 512. The second water level sensor 222 is arranged to measure a water level near a lowest water level in the second stage storage 512.

The distribution pipe 520 is connected to a water supply valve C1 and a drain valve C2. The water supply valve C1 is connected to a water supply pipe 508 that supplies water to the nozzle 216. The water supply valve C1 controls opening and closing of the flow of water supplied from the water tank 218 to the nozzle 216. The drain valve C2 is connected to a drain pipe 514 used to drain water from the water tank 218. The drain pipe 514 is connected to a drain 516 that drains water from the water tank 218 to the outside. When the drain valve C2 is opened, water stored in the water tank 218 is discharged to the outside through the drain pipe 514 and the drain 516.

The distributor 420 receives water from the water tank 218 and delivers the water to the discharge portion 440 via the water supply pipe 508. The distributor 420 includes the water supply valve C1. The water supply valve C1 regulates the flow of water from the water tank 218 to the discharge portion 440. The opening or closing of the water supply valve C1 or degree of opening thereof may be controlled by an electronic control signal.

The machine room 430 includes a control module 518 and an air pump 504 within a predetermined space. The control module 518 includes the processor 210 and the memory 214. The control module 518 may correspond to a microcomputer. The air pump 504 supplies air to the nozzle 216 of the discharge portion 440. An air valve may be provided between the nozzle 216 and the air pump 504. When the air valve is opened while the air pump 504 is operating, the water supplied through the water supply valve C1 may be mixed with air and sprayed as it moves toward the nozzle due to a pressure difference.

The water supply valve C1, the air pump 504, and the air valve may be driven by a driving signal output from the processor 210. The processor 210 determines whether to perform a water spraying operation, based on a detection value of the first water level sensor 220 and a detection value of the second water level sensor 222. The processor 210 controls operations of the water supply valve C1, the air pump 504, and the air valve depending on whether the water spraying operation is to be performed. Furthermore, the processor 210 determines an operation time and an operation cycle of the air pump 504 based on the determined water spraying time and water spraying cycle. Additionally, the processor 210 determines an opening time and an opening cycle of the air valve based on the determined water spraying time and water spraying cycle.

The discharge portion 440 sprays water. The discharge portion 440 includes the nozzle 216 and a step motor 506. The nozzle 216 includes one or more tubes. For example, the nozzle 216 may include two or four tubes. The step motor 506 rotates the nozzle 216 about a rotation axis. The step motor 506 receives a driving signal from the processor 210 to drive the nozzle 216. The processor 210 sets a rotation period and a rotation radius of the step motor 506 according to the drive signal.

FIG. 6 is a diagram illustrating operations of nozzles according to an embodiment of the disclosure.

According to an embodiment of the disclosure, the nozzle 216 is implemented in the form of a two-fluid nozzle. By spraying a mixture of water and air, the two-fluid nozzle may minimize a particle size of sprayed water. By spraying water and air together, the two-fluid nozzle has a long spray distance with a small amount of water. In addition, by spraying water with fine particles, the two-fluid nozzle is advantageous in absorbing latent heat of evaporation and achieves fast evaporation.

FIG. 6 illustrates spray characteristics of a two-fluid nozzle and other types of nozzles when air is mixed into water at a pressure of 0.7 bar (10 psi) in the two-fluid nozzle. The nozzles compared in FIG. 6 are a fine spray single-fluid nozzle, a hollow cone single-fluid nozzle, and a full cone single-fluid nozzle.

Two-fluid nozzles (or air atomizing nozzles) use less water than single-fluid nozzles (or hydraulic atomizing nozzles). As shown in the table of FIG. 6, the two-fluid nozzle has significantly lower water usage compared to the hollow cone single-fluid nozzle and the full cone single-fluid nozzle.

Furthermore, the two-fluid nozzle has a smaller volume median diameter (VMD) than that of the single-fluid nozzles. Although the two-fluid nozzle has similar water usage to the fine spray single-fluid nozzle, it can be seen that the two-fluid nozzle has a significantly smaller VMD than the fine spray single-fluid nozzle. Furthermore, the two-fluid nozzle has a significantly smaller VMD than those of the hollow cone single-fluid nozzle and the full cone single-fluid nozzle.

In addition, the two-fluid nozzle has a uniform spray pattern. The fine spray single-fluid nozzle and the hollow cone single-fluid nozzles exhibit poor uniformity in spray pattern. The full cone single-fluid nozzle has a uniform spray pattern similar to the two-fluid nozzle, but has significantly higher water usage and significantly larger VMD than the two-fluid nozzle.

Therefore, the two-fluid nozzle has the advantages over the single-fluid nozzles of low water usage, long spray distance, spraying of water with finer particles, and a uniform spray pattern. According to an embodiment of the disclosure, the spraying device 100 includes the air pump and uses the two-fluid nozzle, thereby reducing water usage, increasing a water spray distance, and increasing absorption of latent heat of evaporation.

Figure 7:
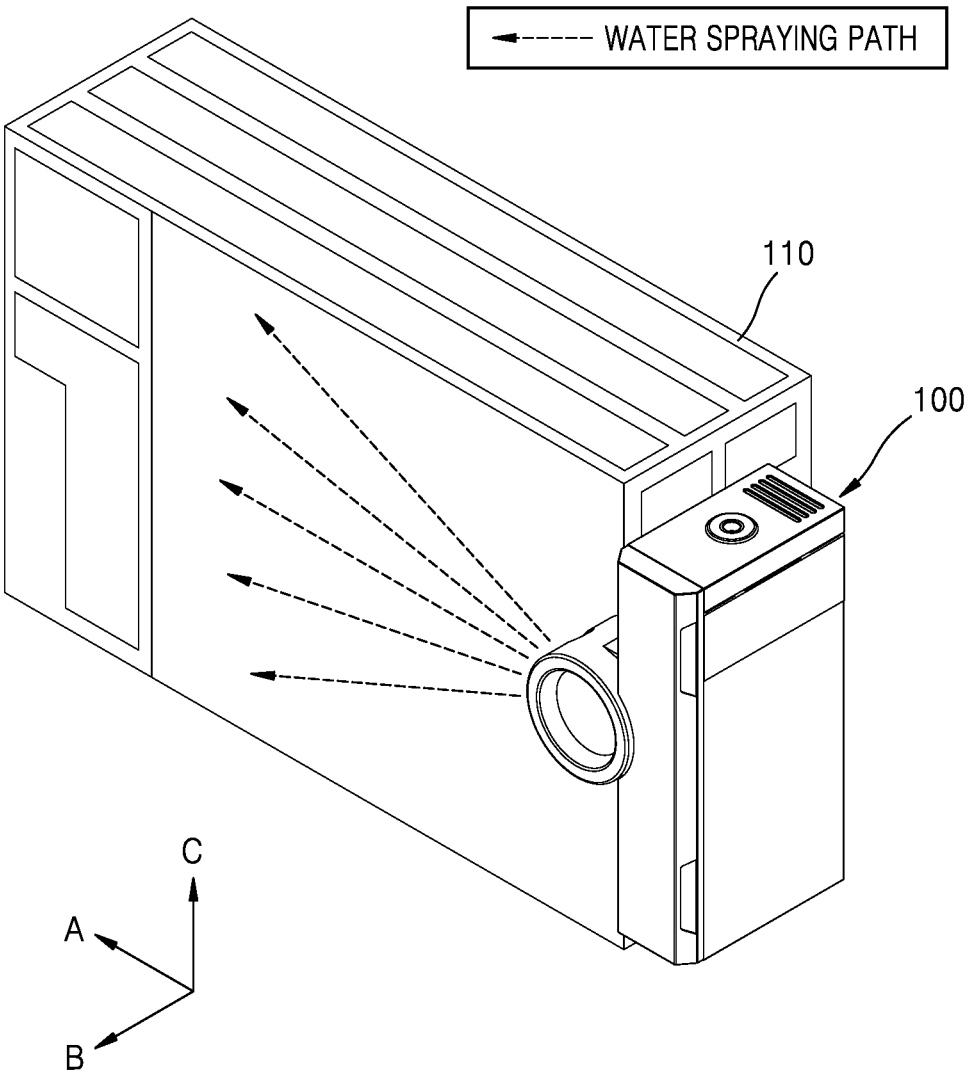
FIG. 7 is a diagram illustrating an outdoor device and a spraying device coupled to each other, according to an embodiment of the disclosure.

FIG. 7 is a diagram illustrating an outdoor device and a spraying device coupled to each other, according to an embodiment of the disclosure.

According to an embodiment of the disclosure, the spraying device 100 is coupled to a housing of the outdoor device 110. The spraying device 100 may be arranged such that the nozzle 216 sprays water toward the outdoor heat exchanger 230 of the outdoor device 110. For example, the spraying device 100 is arranged so that a front of the spraying device 100 corresponding to direction A is coupled to an outer wall of the housing of the outdoor device 110.

The nozzle 216 sprays water onto the outdoor heat exchanger 230 while rotating due to the step motor 506. As the nozzle 216 sprays water while rotating due to the step motor 506, the spraying device 100 may spray water evenly over the entire area of the outdoor heat exchanger 230.

Figure 8:
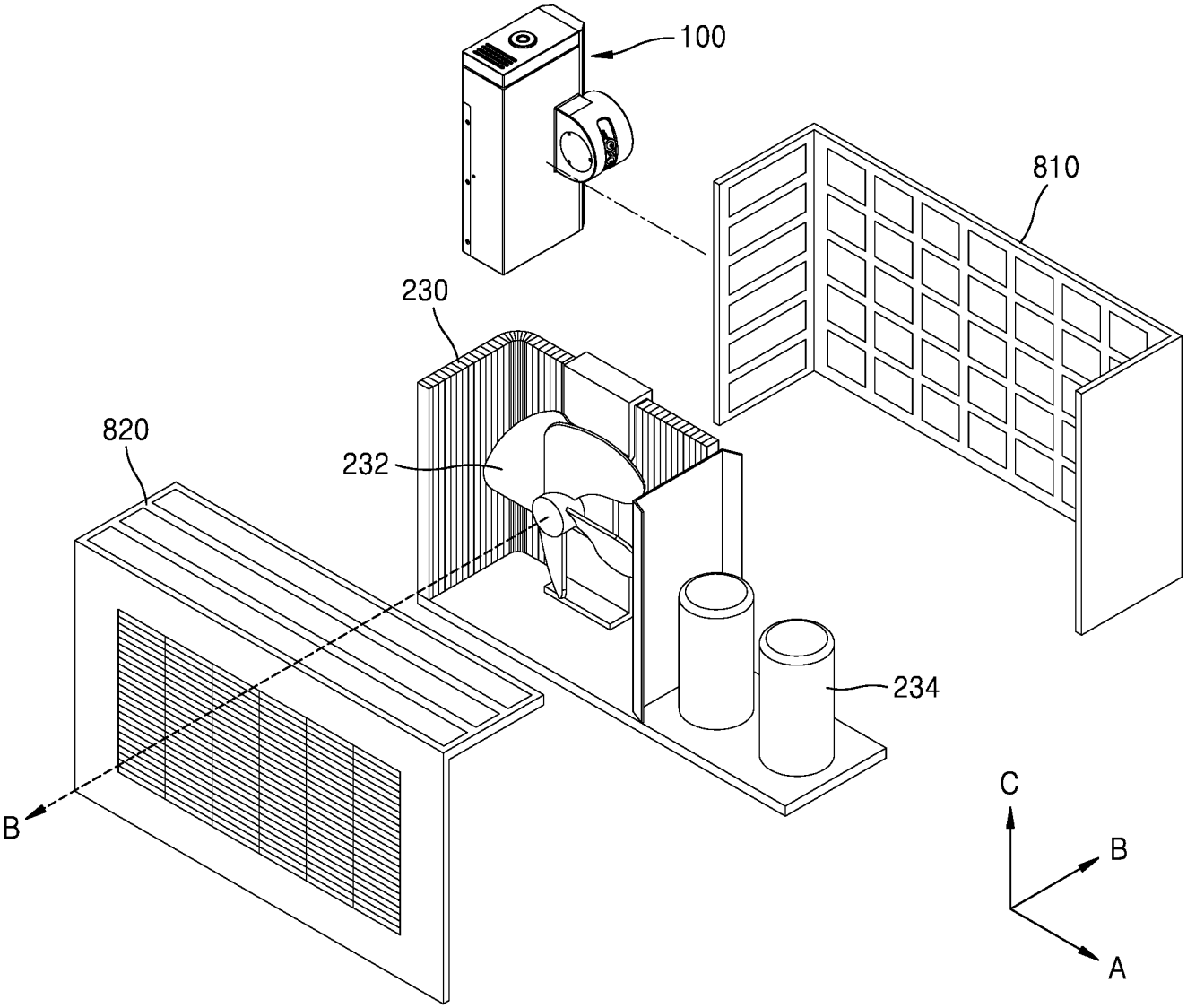
FIG. 8 is a diagram illustrating a structure of a spraying device and an outdoor device, according to an embodiment of the disclosure.

FIG. 8 is a diagram illustrating a structure of a spraying device and an outdoor device according to an embodiment of the disclosure.

According to an embodiment of the disclosure, the spraying device 100 is arranged to spray water onto the outdoor heat exchanger 230. The outdoor device 110 includes the outdoor heat exchanger 230, the fan 232, and the compressor 234 inside housings 810 and 820. As the fan 232 rotates, an airflow is formed in a direction B toward a front of the outdoor device 110. Due to the airflow generated by the fan 232, heat from the outdoor heat exchanger 230 is dissipated in an air-cooled manner.

The spraying device 100 is provided on a side of the housings 810 and 820 of the outdoor device 110. For example, the spraying device 100 may be provided on one side of the rear housing 810 to spray water from the side of the outdoor heat exchanger 230 and coupled to the rear housing 810. When water is sprayed onto the outdoor heat exchanger 230 by the spraying device 100, the sprayed water moves or evaporates in the direction B toward the front of the outdoor device 110 due to the airflow generated by the fan 232.

Figure 9:
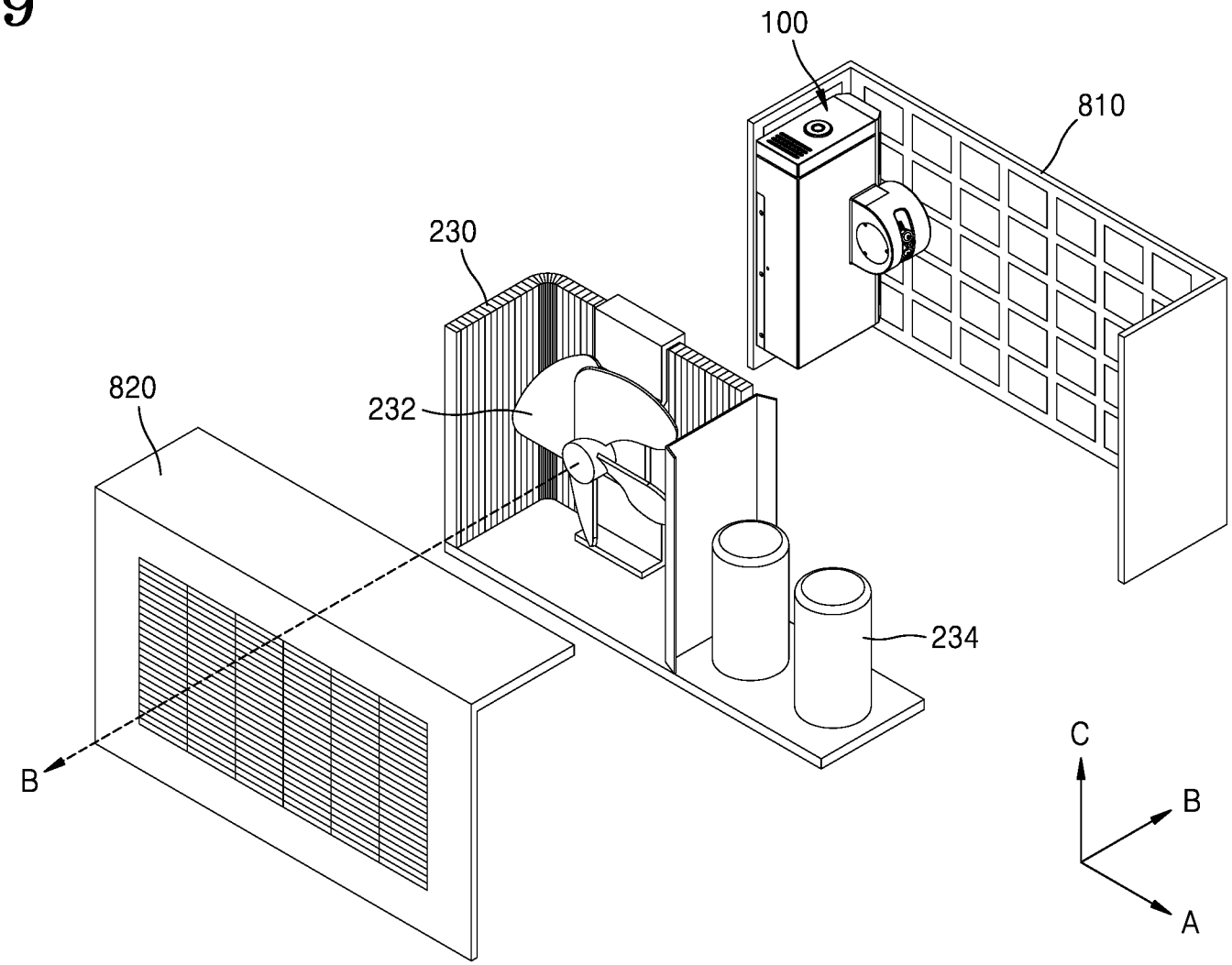
FIG. 9 is a diagram illustrating a structure of a spraying device and an outdoor device, according to an embodiment of the disclosure.

FIG. 9 is a diagram illustrating a structure of a spraying device and an outdoor device, according to an embodiment of the disclosure.

According to an embodiment of the disclosure, the spraying device 100 may be built into the outdoor device 110. The spraying device 100 may be provided on an inner wall of the rear housing 810 to spray water onto the outdoor heat exchanger 230. When the spraying device 100 is built into the outdoor device 110, the spraying device 100 may be connected to the control module 518 of the outdoor device 110 and communicate with the outdoor device 110. The spraying device 100 may receive status information about the outdoor device 110 from the control module 518 of the outdoor device 110. Furthermore, the spraying device 100 may transmit status information about the spraying device 100 to the indoor device 120 via the control module 518 of the outdoor device 110. Additionally, the spraying device 100 may receive power from a power module of the outdoor device 110.

Figure 10:
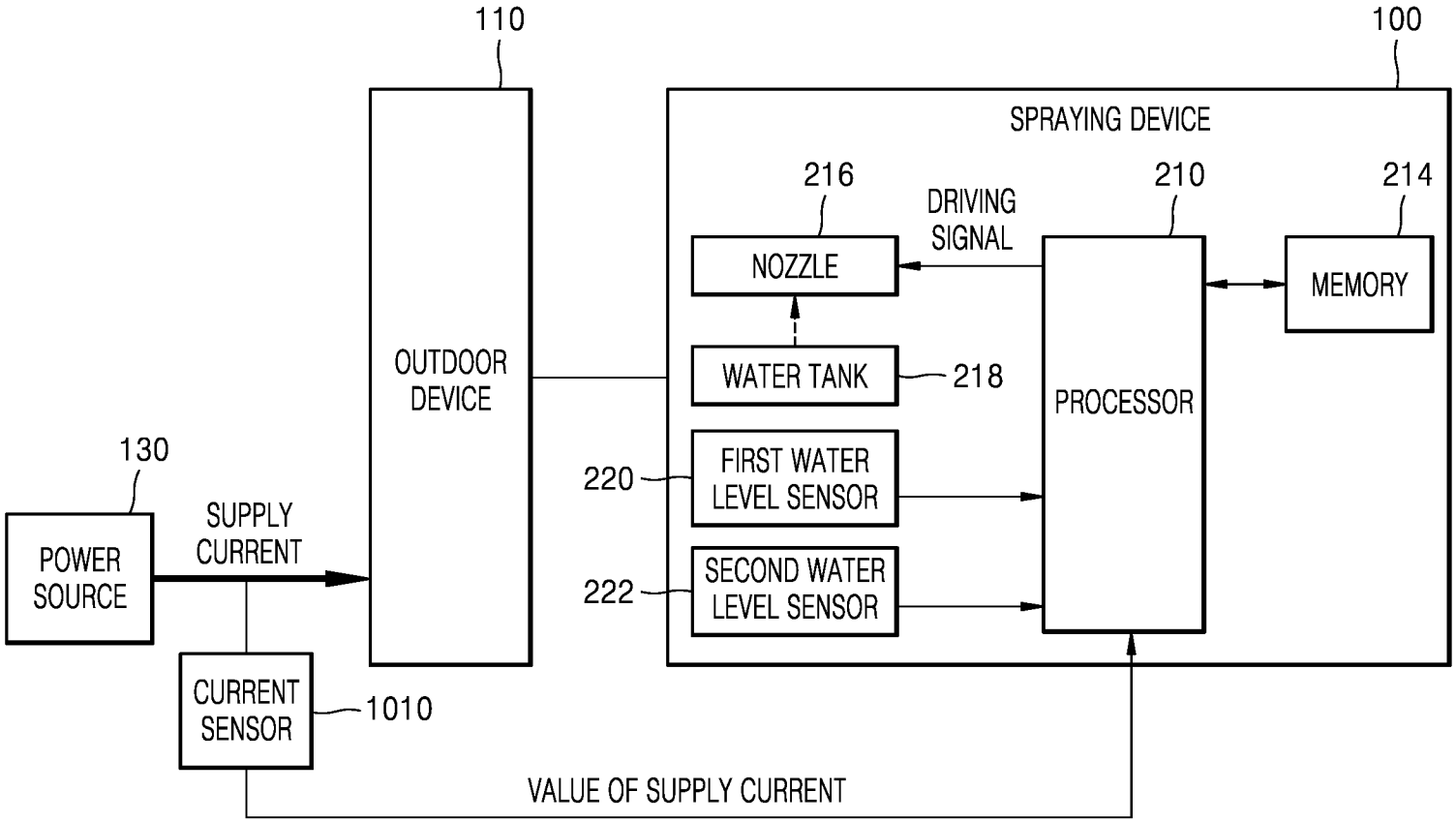
FIG. 10 is a diagram illustrating a spraying device, an outdoor device, and a current sensor, according to an embodiment of the disclosure.

FIG. 10 is a diagram illustrating a spraying device, an outdoor device, and a current sensor according to an embodiment of the disclosure.

According to an embodiment of the disclosure, the spraying device 100 uses a current sensor 1010 to measure and obtain a value of supply current supplied to the outdoor device 110 from the power source 130. The spraying device 100 may determine whether to perform a water spraying operation by using the value of supply current for the outdoor device 110. To do so, the spraying device 100 obtains the value of supply current for the outdoor device 110 from the current sensor 1010 and controls a water spraying operation based on the obtained value of supply current.

The outdoor device 110 receives current from the power source 130. The current sensor 1010 measures current supplied from the power source 130 to the outdoor device 110. The spraying device 100 continuously or periodically receives a value of supply current from the current sensor 1010.

According to an embodiment of the disclosure, when the value of supply current is greater than or equal to a first reference current value, the spraying device 100 determines whether to perform a water spraying operation based on a water level in the water tank 218. The spraying device 100 performs a water spraying operation when the value of supply current is greater than or equal to the first reference current value and the water level in the water tank 218 satisfies a predetermined condition. When the value of supply current is greater than or equal to the first reference current value and the water level in the water tank 218 does not satisfy the predetermined condition, the spraying device 100 does not perform a water spraying operation. When the value of supply current is less than the first reference current value, the spraying device 100 stops the water spraying operation regardless of the water level in the water tank 218.

Figure 11:
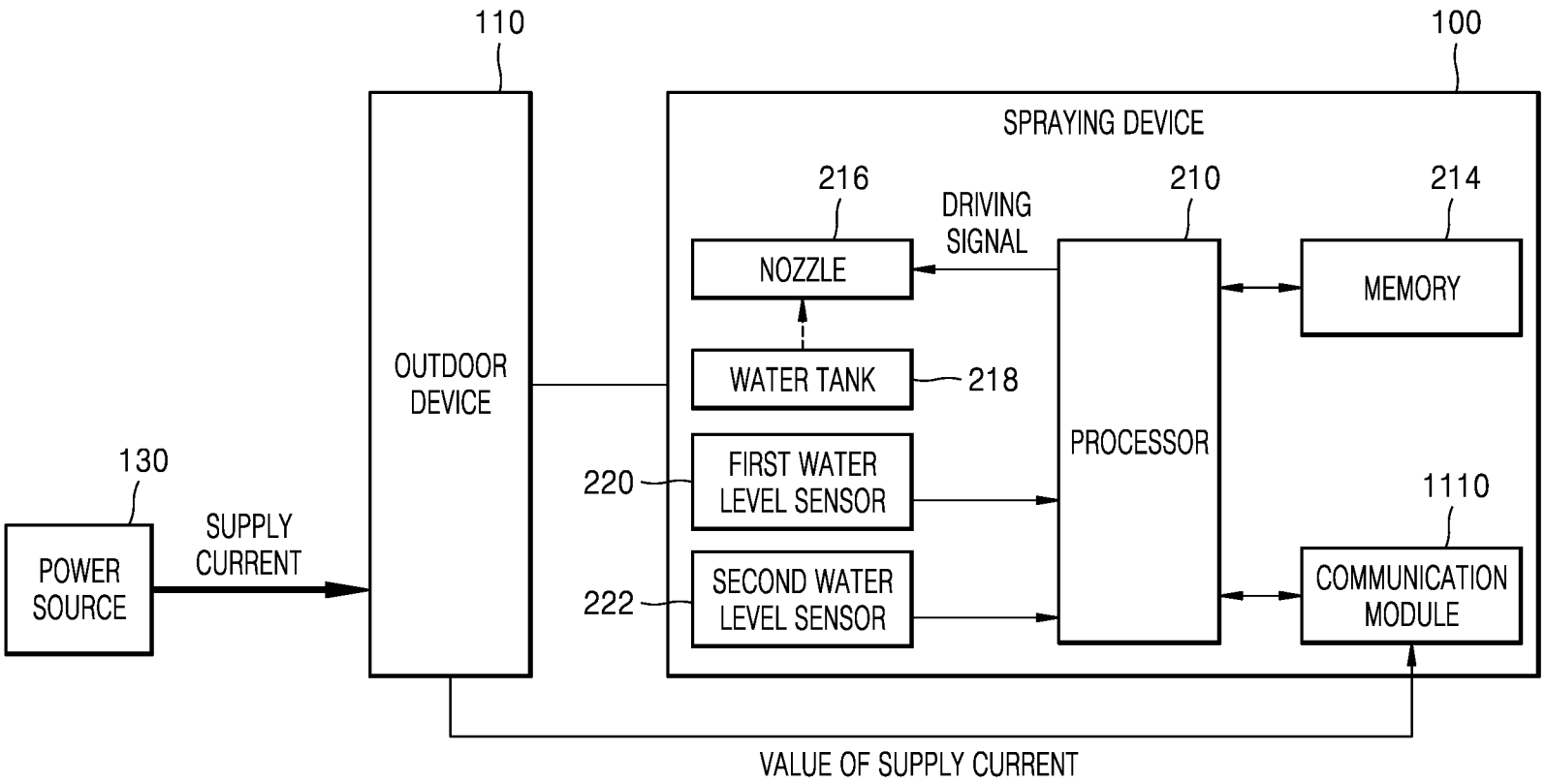
FIG. 11 is a diagram illustrating a structure of a spraying device and an outdoor device, according to an embodiment of the disclosure.

FIG. 11 is a diagram illustrating a structure of a spraying device and an outdoor device, according to an embodiment of the disclosure.

According to an embodiment of the disclosure, the spraying device 100 includes the processor 210, the memory 214, the nozzle 216, the water tank 218, the first water level sensor 220, the second water level sensor 222, and a communication module 1110.

The communication module 1110 may communicate with the outdoor device 110 in a wired or wireless manner. According to an embodiment of the disclosure, the spraying device 100 communicates with the outdoor device 110 by using RS-485 serial communication.

The communication module 1110 may include a wireless communication module (e.g., a cellular communication module, a short-range wireless communication module, or a global navigation satellite system (GNSS) communication module) or a wired communication module (e.g., a LAN communication module or a power line communication (PLC) module). In addition, the communication module 1110 may perform short-range communication by using, for example, Bluetooth, BLE, NFC, Wi-Fi, ZigBee, IrDA communication, WFD, UWB, Ant+ communication, etc. Furthermore, for example, the communication module 1110 may perform long-range communication, and communicate with an external device over, for example, a legacy cellular network, a fifth generation (5G) network, a next-generation communication network, the Internet, or a computer network (e.g., a LAN or WAN).

In addition, for example, the communication module 1110 may perform mobile communication, and transmit or receive a wireless signal to or from at least one of a base station, an external terminal, or a server on a mobile communication network.

According to an embodiment of the disclosure, the communication module 1110 is connected to an AP in the home via Wi-Fi communication. The communication module 1110 may communicate with an external device via the AP.

According to an embodiment of the disclosure, the spraying device 100 may include a microcomputer with the processor 210, the communication module 1110, and the memory 214 configured as a single chip.

The communication module 1110 receives, from the outdoor device 110, a value of supply current for the outdoor device 110. The outdoor device 110 receives a driving current from the power source 130. The outdoor device 110 periodically transmits a value of supply current to the spraying device 100.

According to an embodiment of the disclosure, the outdoor device 110 periodically outputs a value of supply current via RS-485 communication. The outdoor device 110 is connected to the indoor device 120 and the spraying device 100 via the RS-485 communication. When the outdoor device 110 periodically outputs a value of supply current, the indoor device 120 and the spraying device 100 connected via the RS-485 communication each receive the value of supply current output from the outdoor device 110. A packet containing the value of supply current output from the outdoor device 110 may include information indicating that the outdoor device 110 is a transmitter, measurement time information, and the value of supply current.

The spraying device 100 may receive, via the communication module 1110, information transmitted using the RS-485 communication. The processor 210 controls a water spraying operation by using the information received via the communication module 1110. The processor 210 may use the information received via the communication module 1110 to control whether to perform a water spraying operation, a water spraying cycle, a water spraying duty ratio, a water spray pattern, or a nozzle rotation angle.

According to an embodiment of the disclosure, when the value of supply current is greater than or equal to a first reference current value, the spraying device 100 determines whether to perform a water spraying operation based on a water level in the water tank 218. The spraying device 100 performs a water spraying operation when the value of supply current is greater than or equal to the first reference current value and the water level in the water tank 218 satisfies a predetermined condition. When the value of supply current is greater than or equal to the first reference current value and the water level in the water tank 218 does not satisfy the predetermined condition, the spraying device 100 does not perform a water spraying operation. When the value of supply current is less than the first reference current value, the spraying device 100 stops the water spraying operation regardless of the water level in the water tank 218.

Figure 12:
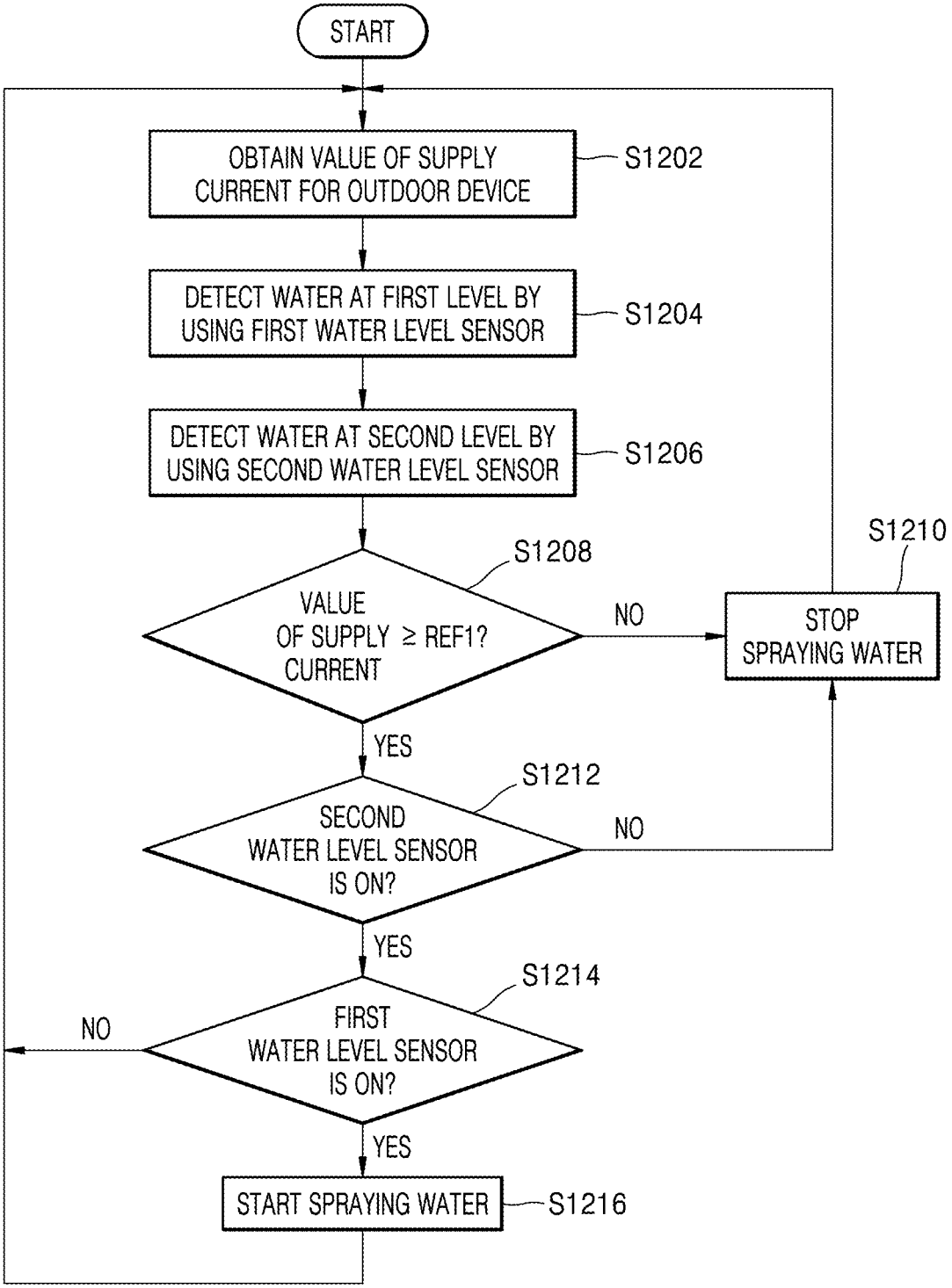
FIG. 12 is a flowchart of a method of controlling a spraying device, according to an embodiment of the disclosure.

FIG. 12 is a flowchart of a method of controlling a spraying device, according to an embodiment of the disclosure.

According to an embodiment of the disclosure, the spraying device 100 determines whether to perform a water spraying operation, based on a value of supply current for the outdoor device 110, a detection value of the first water level sensor 220, and a detection value of the second water level sensor 222.

In operation S1202, the spraying device 100 obtains the value of supply current for the outdoor device 110. According to an embodiment of the disclosure, the spraying device 100 obtains the value of supply current for the outdoor device 110 by using the current sensor 1010. Furthermore, according to an embodiment of the disclosure, the spraying device 100 receives the value of supply current from the outdoor device 110 via the communication module 1110.

In operation S1204, the spraying device 100 detects water at a first water level by using the first water level sensor 220. Furthermore, in operation S1206, the spraying device 100 detects water at a second water level by using the second water level sensor 222.

The order of operations S1202, S1204, and S1206 is not limited to the order illustrated in FIG. 12. Operations S1202, S1204, and S1206 may be performed in parallel. Additionally, operations S1202, S1204, and S1206 may be performed in various orders. The value of supply current for the outdoor device 110 may be obtained continuously or periodically while power is applied to the spraying device 100. In addition, while power is applied to the spraying device 100, the first water level sensor 220 and the second water level sensor 222 may continuously or periodically detect water and generate detection values, respectively.

Next, in operation S1208, the spraying device 100 determines whether the value of supply current is greater than or equal to a first reference current value Ref1. According to an embodiment of the disclosure, the spraying device 100 performs a water spraying operation only when the outdoor device 110 is in operation. The spraying device 100 does not perform a water spraying operation unnecessarily when the outdoor device 110 is not in operation. The spraying device 100 may determine whether the outdoor device 110 is operating by using the value of supply current for the outdoor device 110. The first reference current value Ref1 may be set such that the spraying device 100 may determine whether the outdoor device 110 is operating. The first reference current value Ref1 may correspond to a minimum value of supply current when the outdoor device 110 is operating.

When the value of supply current is less than the first reference current value Ref1, the spraying device 100 stops a water spraying operation in operation S1210. When the spraying device 100 is performing a water spraying operation, the spraying device 100 stops a water spraying operation by closing the water supply valve C1 in operation S1210. When the spraying device 100 is not performing the water spraying operation, the spraying device 100 maintains the water supply valve C1 in a closed state in operation S1210.

When the value of supply current is greater than or equal to the first reference current value Ref1, in operation S1212, the spraying device 100 determines whether water is detected by the second water level sensor 222. When a current that is greater than or equal to a reference value is detected by the second water level sensor 222, the spraying device 100 may determine that water is detected by the second water level sensor 222.

When the water is not detected by the second water level sensor 222, the spraying device 100 stops the water spraying operation in operation S1210.

When the water is detected by the second water level sensor 222, in operation S1214, the spraying device 100 determines whether water is detected by the first water level sensor 220. When a current greater than or equal to a reference value is detected by the first water level sensor 220, the spraying device 100 may determine that the water is detected by the first water level sensor 220.

When the water is not detected by the first water level sensor 220, the spraying device 100 obtains a value of supply current for the outdoor device 110 in operation 1202, detects water at the first water level by using the first water level sensor 220 in operation S1204, detects water at the second water level by using the second water level sensor 222 in operation S1206, and repeats the operation of determining whether to spray water.

When the water is detected by the first water level sensor 220, the spraying device 100 starts the water spraying operation in operation S1216. When the spraying device 100 is not currently performing the water spraying operation, the spraying device 100 changes the water supply valve C1 to an open state and starts the water spraying operation. When the spraying device 100 is currently performing the water spraying operation, the spraying device 100 maintains the open state of the water supply valve C1 to perform the water spraying operation.

After operation S1216, the spraying device 100 obtains a value of supply current for the outdoor device 110 in operation 1202, detects water at the first water level by using the first water level sensor 220 in operation S1204, detects water at the second water level by using the second water level sensor 222 in operation S1206, and repeats the operation of determining whether to spray water.

According to an embodiment of the disclosure, a starting condition for a water spraying operation is defined as when a value of supply current for the outdoor device 110 is greater than or equal to the first reference current value, and water is detected by both the first water level sensor 220 and the second water level sensor 222. Even in a case where water is not detected by the first water level sensor 220 after starting the water spraying operation, the water spraying operation is not stopped when the water is detected by the second water level sensor 222 and a value of supply current for the outdoor device 110 is greater than or equal to the first reference current value. That is, after the water spraying operation is started, when the value of supply current for the outdoor device 110 is greater than or equal to the first reference current value and there is only water in the water tank 218 at the second water level or higher, the water spraying operation continues to be performed. However, in a state in which the water spraying operation is not started, the water spraying operation is started only when the value of supply current of the outdoor device 110 is greater than or equal to the first reference current value and water at the first level or higher is stored in the water tank 218, whereas the water spraying operation is not started even when a water level in the water tank 218 is higher than the second water level but is lower than the first water level. When the operation of the outdoor device 110 is stopped so the value of supply current for the outdoor device 110 is less than the first reference current value, the water spraying operation is stopped regardless of the water level in the water tank 218. According to an embodiment of the disclosure, by determining whether to perform a water spraying operation, based on a value of supply current for the outdoor device 110 and a water level in the water tank 218, it is possible to prevent unnecessary water spraying operations and enable appropriate control of the water spraying operation according to the water level in the water tank 218, by reflecting together an operating state of the outdoor device 110 and a water level in the water tank 218 of the spraying device 100.

Figure 13:
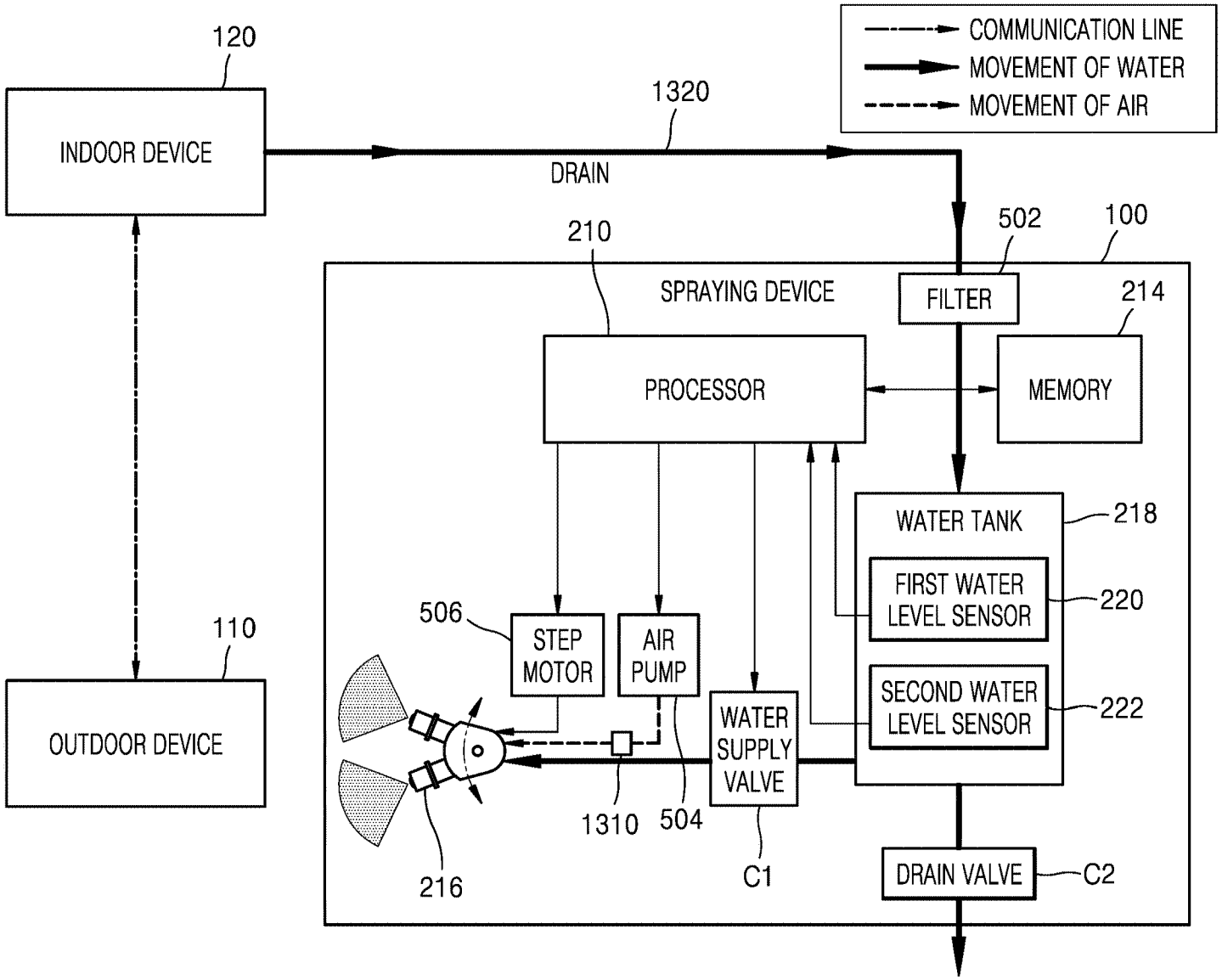
FIG. 13 is a diagram illustrating a structure of a spraying device, an indoor device, and an outdoor device, according to an embodiment of the disclosure.

FIG. 13 is a diagram illustrating a structure of a spraying device, an indoor device, and an outdoor device, according to an embodiment of the disclosure.

According to an embodiment of the disclosure, the outdoor device 110 and the indoor device 120 communicate with each other and transmit and receive status information therebetween. According to an embodiment of the disclosure, the spraying device 100 may include the communication module 1110 and communicate with the outdoor device 110 and the indoor device 120.

According to an embodiment of the disclosure, the spraying device 100 includes the processor 210, the memory 214, the nozzle 216, the water tank 218, the first water level sensor 220, the second water level sensor 222, the filter 502, the air pump 504, the step motor 506, the water supply valve C1, the drain valve C2, and an air valve 1310.

According to an embodiment of the disclosure, the spraying device 100 includes the water supply valve C1 and the drain valve C2.

The water supply valve C1 controls the supply of water from the water tank 218 to the nozzle 216. The processor 210 may control the water supply valve C1 to supply water from the water tank 218 to the nozzle 216 or to block the supply of water from the water tank 218 to the nozzle 216. The water tank 218 may have a hydrostatic pressure due to an internal height difference. According to an embodiment of the disclosure, water may be supplied from the water tank 218 to the nozzle 216 when the water supply valve C1 is opened without a separate pump, by using the hydrostatic pressure due to the height difference within the water tank 218.

The drain valve C2 controls drainage of water from the water tank 218 to the drain pipe 514. When the drain valve C2 is opened, the water in the water tank 218 is discharged to the outside through the drain pipe 514 and the drain 516.

While the water supply valve C1 is opened so the water from the water tank 218 is supplied to the nozzle 216, air is supplied to the nozzle 216 from the air pump 504. To accomplish this, while the water supply valve C1 is opened, the processor 210 opens the air valve 1310 to supply high-pressure air from the air pump 504 to the nozzle 216.

The step motor 506 rotates the nozzle 216 about a rotation axis. The step motor 506 receives a driving signal from the processor 210 to drive the nozzle 216. The processor 210 sets a rotation period and a rotation radius of the step motor 506 according to the drive signal.

According to an embodiment of the disclosure, the water tank 218 may receive condensate water via a drain hose 1320 of the indoor device 120. The condensate water delivered to the spraying device 100 via the drain hose 1320 of the indoor device 120 is supplied through the filter 502 to an inlet of the water tank 218. The water tank 218 stores the condensate water from the indoor device 120.

Figure 14:
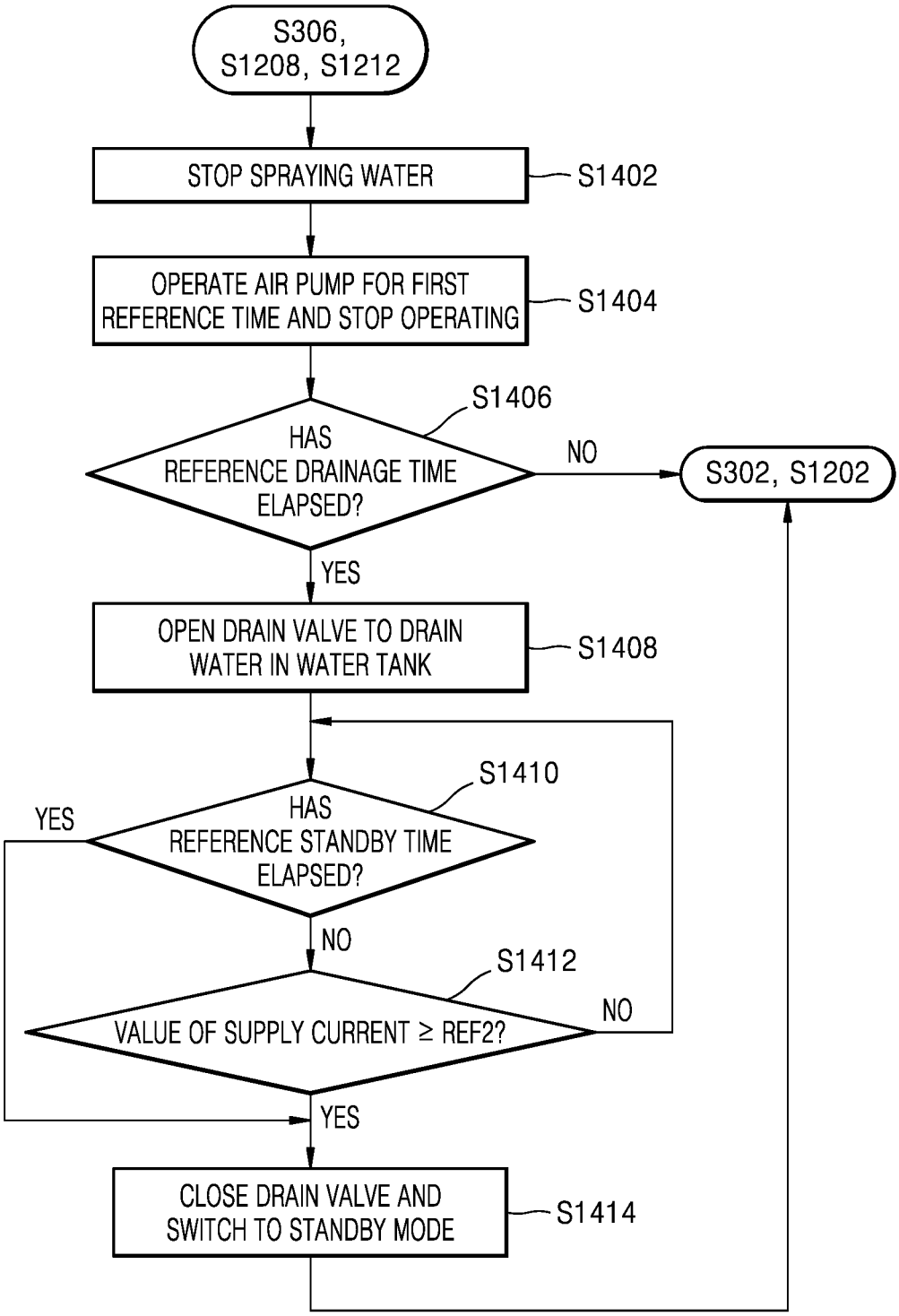
FIG. 14 is a flowchart of a drainage control operation of a spraying device, according to an embodiment of the disclosure.

FIG. 14 is a flowchart of a drainage control operation of a spraying device, according to an embodiment of the disclosure.

According to an embodiment of the disclosure, when the water level in the water tank 218 is below the second water level (S306 or S1212) or when the value of supply current for the outdoor device 110 is less than the first reference current value Ref1 (S1208), the spraying device 100 stops the water spraying operation in operation S1402. The spraying device 100 stops the water spraying operation by closing the water supply valve C1.

After stopping the water spraying operation, in operation S1404, the spraying device 100 operates the air pump 504 for a first reference time and then stops operating the air pump 504. The first reference time may be set to, for example, 1 minute. In operation S1404, the air valve 1310 is opened, and high-pressure air is output from the air pump 504 to the nozzle 216. By supplying air from the air pump 504 to the nozzle 216 with the water supply valve C1 closed, the water remaining in the nozzle 216 is dried. Through this drying operation, the spraying device 100 may prevent the nozzle 216 from clogging. According to an embodiment of the disclosure, by drying the water in the nozzle 216, the spraying device 100 may prevent nozzle clogging which is a major drawback of a two-fluid nozzle.

Next, in operation S1406, the spraying device 100 determines whether a reference drainage time has elapsed since stoppage of the water spraying operation. The reference drainage time may be set to, for example, 24 hours. When the reference drainage time has not elapsed since stoppage of the water spraying operation, the spraying device 100 returns to operation S302 or operation S1202 to perform a water spraying control operation. When it is determined that the drain reference time has elapsed since stoppage of the water spray operation in operation S1406, the spraying device 100 opens the drain valve C2 to drain the water stored in the water tank 218 in operation S1408.

When the outdoor device 110 is operating below reference power consumption and then stops operating, unsprayed condensate water is stored in the water tank 218. Furthermore, even when the operation of the air conditioner 10 is stopped, a certain amount of condensate water is generated from the indoor device 120 and collected in the water tank 218. The condensate water stored in this way may be used later when starting the operation of the air conditioner 10 to achieve greater power savings in the air conditioner 10 with relatively high initial power consumption. However, when water is stored in the water tank 218 for a long period of time, scale or the like may occur within the water tank 218. According to an embodiment of the disclosure, when the spraying device 100 is not operated for more than the reference drainage time, the spraying device 100 opens the drain valve C2 to drain all the water inside, thereby preventing the occurrence of scale or deposits in the water tank 218.

Subsequently, in operation S1410, the spraying device 100 drains the water from the water tank 218 and determines whether a reference standby time has elapsed. The reference standby time may be set to, for example, 60 minutes.

When the reference standby time has elapsed since draining the water in the water tank 218, in operation S1414, the spraying device 100 closes the drain valve C2 and switches its operating mode to a standby mode. In the standby mode, the water supply valve C1 and the drain valve C2 are both set to a closed state, and the step motor 506 is initialized to move the nozzle 216 to a predetermined initial position.

When the reference standby time has not elapsed since draining the water in the water tank 218, in operation S1412, the spraying device 100 determines whether a value of supply current for the outdoor device 110 is greater than or equal to a second reference current value. The second reference current value is a current value corresponding to power used during an initial operation of the air conditioner 10. For example, the second reference current value may be set to a current value corresponding to power consumption of approximately 1 kW.

When the value of supply current for the outdoor device 110 is greater than or equal to the second reference current value, in operation S1414, the spraying device 100 closes the drain valve C2 and switches its operating mode to the standby mode. When the value of supply current for the outdoor device 110 is less than the second reference current value, in operation S1410, the spraying device 100 determines whether the reference standby time has lapsed since draining water in the water tank 218. The spraying device 100 determines whether the value of the supply current for the outdoor device 110 is greater than or equal to the first reference current value during the reference standby time, and then when the value of supply current is less than the first reference current value during the reference standby time, the spraying device 100 closes the drain valve C2 and switches its operating mode to the standby mode in operation S1414.

After operation S1414, the spraying device 100 returns to operation S302 or operation S1202 to perform a water spraying control operation.

Figure 15:
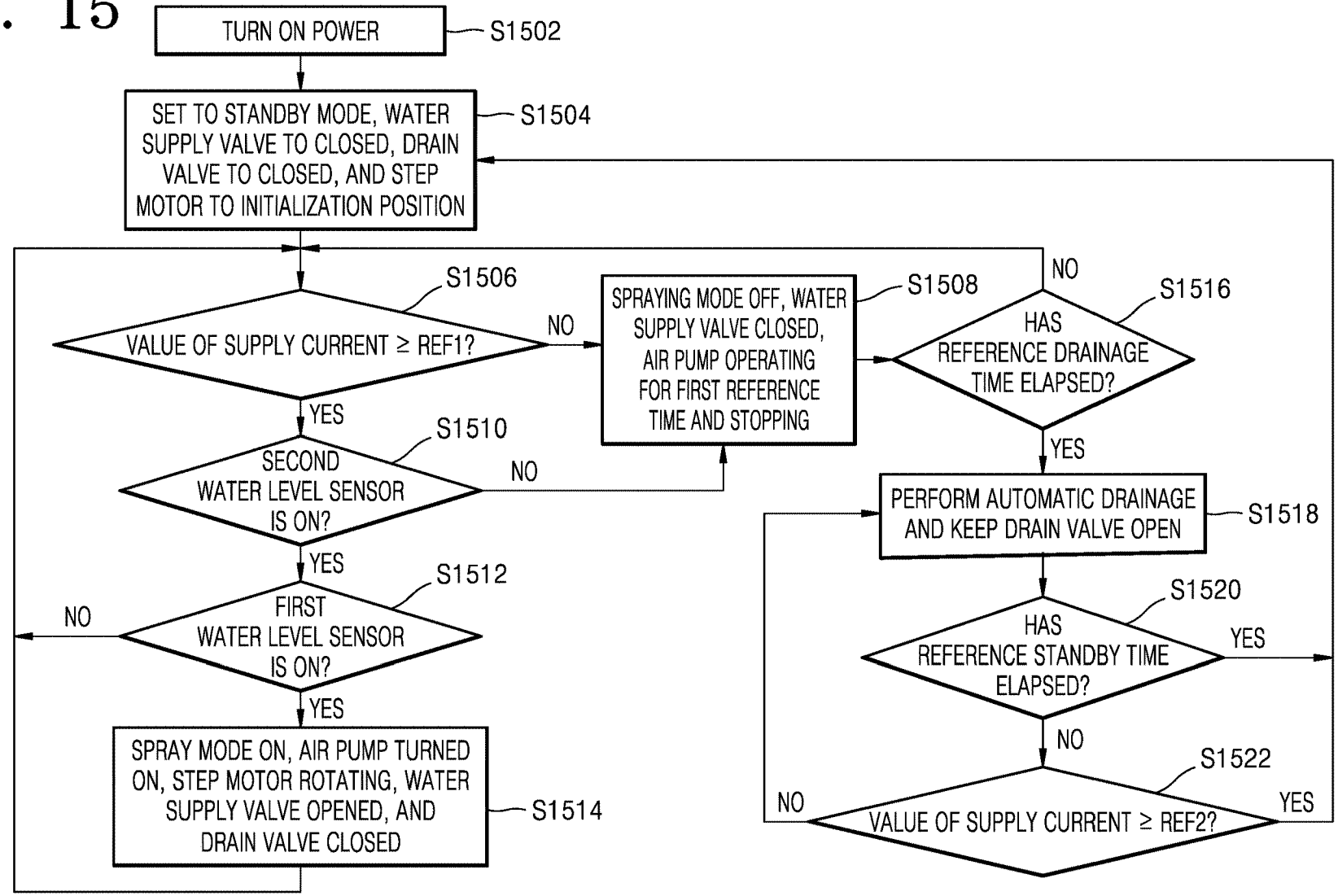
FIG. 15 is a flowchart of a method of controlling a spraying device, according to an embodiment of the disclosure.

FIG. 15 is a flowchart of a method of controlling a spraying device, according to an embodiment of the disclosure.

In operation S1502, the spraying device 100 turns on power.

In operation S1504, the spraying device 100 operates in a standby mode. In the standby mode, the spraying device 100 sets the water supply valve C1 and the drain valve C2 both to a closed state. In addition, in the standby mode, the spraying device 100 sets a position of the step motor 506 to an initialization position. The step motor 506 at the initialization position moves the nozzle 216 to an initial position.

Next, in operation S1506, the spraying device 100 determines whether a value of supply current for the outdoor device 110 is greater than or equal to the first reference current value.

When the value of supply current is greater than or equal to the first reference current value, in operation S1510, the spraying device 100 determines whether water is detected by the second water level sensor 222 of the water tank 218. When the water is detected by the second water level sensor 222, in operation S1512, the spraying device 100 determines whether water is detected by the first water level sensor 220.

When the water is detected by the first water level sensor 220, in operation S1514, the spraying device 100 operates in a spraying mode to perform a spraying operation. In the spraying mode, air is output from the air pump 504, and the air valve 1310 is opened. Furthermore, in the spraying mode, the step motor 506 rotates at a predetermined rotation angle. In addition, in the spraying mode, the water supply valve C1 is opened and the drain valve C2 is closed.

While operating in the spraying mode, the spraying device 100 repeatedly determines whether to perform a spraying operation by repeating operations S1506, S1510, and S1512.

When the water is not detected by the first water level sensor 220 in operation S1512, the spraying device 100 returns to operation S1506 to determine whether a value of supply current is greater than or equal to the first reference current value. When the water is not detected by the first water level sensor 220 while the spraying device 100 is operating in the spraying mode by performing a spraying operation, the spraying device 100 continues to perform the spraying operation and operate in the spraying mode. When the water is not detected by the first water level sensor 220 while the spraying operation is not started, the water spraying operation of the spraying device 100 is not started.

When the water is not detected by the second water level sensor 222 in operation S1510, the spraying mode is stopped. When the water is not detected by the second water level sensor 222 while the spraying device 100 is operating in the spraying mode by performing the spraying operation, the spraying device 100 stops the spraying mode. When the water is not detected by the second water level sensor 222 while the spraying operation is not started, the water spraying operation of the spraying device 100 is not started.

When the value of supply current for the outdoor device 110 is less than the first reference current value in operation S1506, the spraying mode is stopped. When the value of supply current for the outdoor device 110 is less than the first reference current value while the spraying device 100 is operating in the spraying mode by performing the spraying operation, the spraying device 100 stops the spraying mode. When the value of supply current for the outdoor device 110 is less than the first reference current value while the spraying operation is not started, the water spraying operation of the spraying device 100 is not started.

When the spraying mode is stopped in operation S1508, the water supply valve C1 is closed. Furthermore, when the spraying mode is stopped in operation S1508, the air pump 504 operates for a first reference time with the air valve 1310 open and then stops operating. When the spraying mode is stopped, the spraying device 100 operates the air pump 504 for the first reference time to dry residual moisture in the nozzle 216.

Subsequently, in operation S1516, the spraying device 100 determines whether a reference drainage time has elapsed since the spraying mode was stopped. When the reference drainage time has not elapsed since the spraying mode was stopped, the spraying device 100 returns to operation S1506 to determine whether to perform a spraying operation.

When the reference drainage time has elapsed since the spraying mode was stopped, in operation S1518, the spraying device 100 performs an automatic drainage operation to drain water from the water tank 218. In operation S1518, the spraying device 100 performs the automatic drainage operation by opening the drain valve C2.

Next, in operation S1520, the spraying device 100 determines whether a reference standby time has elapsed since the drainage operation. When the reference standby time has elapsed since the drainage operation, the spraying device 100 returns to operation S1504 and switches to the standby mode When the reference standby time has not elapsed since the drainage operation, in operation S1522, the spraying device 100 determines whether a value of supply current for the outdoor device 110 is greater than or equal to the second reference current value. When the value of supply current for the outdoor device 110 is less than the second reference current value, the spraying device 100 returns to operation S1518 and maintains the drain valve C2 in an open state. When the value of supply current for the outdoor device 110 is greater than or equal to the second reference current value, the spraying device 100 returns to operation S1504 and switches to the standby mode.

A machine-readable storage medium may be provided in the form of a non-transitory storage medium. In this regard, the term 'non-transitory' only means that the storage medium does not include a signal and is a tangible device, and the term does not differentiate between where data is semi-permanently stored in the storage medium and where the data is temporarily stored in the storage medium. For example, the 'non-transitory storage medium' may include a buffer in which data is temporarily stored.

According to an embodiment, methods according to various embodiments of the disclosure may be included in a computer program product when provided. The computer program product may be traded, as a product, between a seller and a buyer. The computer program product may be distributed in the form of a machine-readable storage medium (e.g., compact disc-ROM (CD-ROM)) or distributed (e.g., downloaded or uploaded) on-line via an application store or directly between two user devices (e.g., smartphones). For online distribution, at least a part of the computer program product may be at least transiently stored or temporally generated in the machine-readable storage medium such as memory of a server of a manufacturer, a server of an application store, or a relay server.

According to an aspect of the disclosure, there is provided a spraying device for spraying water onto an outdoor device of an air conditioner. The spraying device may include a water tank configured to store water. Furthermore, the spraying device may include a first water level sensor configured to detect the stored water at a first water level of the water tank. Furthermore, the spraying device may include a second water level sensor configured to detect the stored water at a second water level of the water tank that is lower than the first water level of the water tank. Furthermore, the spraying device may include a nozzle configured to spray the stored water onto the outdoor device. Furthermore, the spraying device includes a memory storing at least one instruction. Furthermore, the spraying device may include at least one processor. The at least one processor may be configured to execute the at least one instruction to with the stored water not being sprayed onto the outdoor device: start spraying the stored water onto the outdoor device, based on the stored water being detected at the first water level of the water tank by the first water level sensor and the stored water being detected at the second water level of the water tank by the second water level sensor. Furthermore, the at least one processor may be configured to perform control to with the stored water being sprayed onto the outdoor device: stop spraying the stored water onto the outdoor device, based on the stored water not being detected at the second water level of the water tank by the second water level sensor.

According to an aspect of the disclosure, the at least one processor may be further configured to execute the at least one instruction to: obtain a value of a supply current supplied to the outdoor device, and the start of spraying may start spraying based on the value of the supply current being greater than or equal to a first reference current value and based on the stored water being detected at the first water level of the water tank by the first water level sensor and the stored water being detected at the second water level of the water tank by the second water level sensor.

According to an aspect of the disclosure, the at least one processor may be further configured to execute the at least one instruction to stop spraying based on the value of the supply current being less than the first reference current value.

According to an aspect of the disclosure, the spraying device may further include a drain valve configured to drain the stored water from the water tank. Furthermore, the at least one processor may be further configured to execute the at least one instruction to: open the drain valve to drain the stored water from the water tank based on a reference drainage time having elapsed since the stopping of the spraying.

According to an aspect of the disclosure, the at least one processor may be further configured to execute the at least one instruction to: close the drain valve based on a reference standby time having elapsed since the opening the drain valve and the value of the supply current being greater than or equal to a second reference current value, and the second reference current value may correspond to the value of the supply current during an initial operation of the air conditioner in which the air conditioner starts operating.

According to an aspect of the disclosure, the spraying device may further include a current sensor configured to measure the value of the supply current supplied to the outdoor device. Furthermore, the obtained value may correspond to the value of the supply current measured by the current sensor.

According to an aspect of the disclosure, the spraying device may further include a communication module configured to communicate with the outdoor device. Furthermore, the value of the supply current may be obtained from the outdoor device via the communication module.

According to an aspect of the disclosure, the spraying device may further include a water supply valve configured to open and close to open and close, respectively, a supply of the stored water to the nozzle. Furthermore, the at least one processor may be further configured to execute the at least one instruction to: open the water supply valve to start the spraying of the stored water onto the outdoor device, and close the water supply valve to stop the spraying of the stored water onto the outdoor device.

According to an aspect of the disclosure, the spraying device may further include an air pump configured to inject air into the nozzle. Furthermore, the at least one processor may be further configured to execute the at least one instruction to: with the water supply valve being open: control the air pump to inject air into the nozzle.

According to an aspect of the disclosure, the at least one processor may be further configured to execute the at least one instruction to: with the water supply valve being closed: control the air pump to inject air into the nozzle for a first reference time after the water supply valve is closed, and when the first reference time has elapsed since the water supply valve is closed, control the air pump to stop injecting air into the nozzle.

According to an aspect of the disclosure, the water tank may include a water inlet configured to receive condensate water from an indoor device of the air conditioner.

According to an aspect of the disclosure, the spraying device may further include a step motor configured to rotate the nozzle. Furthermore, the at least one processor may be further configured to execute the at least one instruction to: control the step motor to rotate the nozzle.

According to an aspect of the disclosure, the water tank may include a first stage and a second stage having a lower surface lower than a first stage lower surface and a drain hole configured to drain the stored water into the nozzle. Furthermore, the second stage may include a narrower and deeper shape than the first stage. Furthermore, the first water level sensor may be configured to detect the stored water at the first water level of the water tank in the first stage. Furthermore, the second water level sensor may be configured to detect the stored water at the second water level of the water tank in the second stage.

Further, according to an aspect of the disclosure, there is provided a method of controlling a spraying device for spraying water onto an outdoor device of an air conditioner. The method of controlling the spraying device may include detecting stored water at a first water level of a water tank of the spraying device by using a first water level sensor. Furthermore, the method of controlling the spraying device may include detecting the stored water at a second water level of the water tank that is lower than the first water level of the water tank by using a second water level sensor. Furthermore, the method of controlling the spraying device may include, with the stored water not being sprayed onto the outdoor device: starting spraying the stored water onto the outdoor device, based on the stored water being detected at the first water level of the water tank by the first water level sensor and the stored water being detected at the second water level of the water tank by the second water level sensor. Furthermore, the method of controlling the spraying device may include stopping spraying the stored water onto the outdoor device, based on the stored water not being detected at the second water level of the water tank by the second water level sensor.

According to an aspect of the disclosure, the method of controlling the spraying device may include obtaining a value of a supply current supplied to the outdoor device. Furthermore, the starting spraying may include starting spraying based on the value of the supply current being greater than or equal to a first reference current value and based on the stored water being detected at the first water level of the water tank by the first water level sensor and the stored water being detected at the second water level of the water tank by the second water level sensor.

According to an aspect of the disclosure, the stopping spraying may include stopping spraying based on the value of the supply current being less than the first reference current value.

According to an aspect of the disclosure, the method of controlling the spraying device may include opening a drain valve of the spraying device to drain the stored water from the water tank, based on a reference drainage time having elapsed since the stopping spraying.

According to an aspect of the disclosure, the method of controlling the spraying device may include closing the drain valve of the spraying device to stop draining the stored water from the water tank, based on a reference standby time having elapsed since the opening the drain valve and the value of the supply current being greater than or equal to a second reference current value. Furthermore, the second reference current value may correspond to the value of the supply current during an initial operation of the air conditioner in which the air conditioner starts operating.

According to an aspect of the disclosure, the method of controlling the spraying device may include opening a water supply valve, which is configured to open and close to open and close, respectively, a supply of stored water to a nozzle configured spray the stored water onto the outdoor device, to start the spraying of the stored water onto the outdoor device; and closing the water supply valve to stop the spraying of the stored water onto the outdoor device.

According to an aspect of the disclosure, there is provided a computer-readable recording medium having recorded thereon a program for performing, on a computer, a method of controlling a spraying device.

The invention claimed is:

1. A spraying device for spraying water onto an outdoor device of an air conditioner, the spraying device comprising:
- a water tank configured to store water;
- a first water level sensor configured to detect the stored water at a first water level of the water tank;
- a second water level sensor configured to detect the stored water at a second water level of the water tank that is lower than the first water level of the water tank;
- a nozzle configured to spray the stored water onto the outdoor device;
- a memory storing at least one instruction; and
- at least one processor configured to execute the at least one instruction to:
  - with the stored water not being sprayed onto the outdoor device:
    - start spraying the stored water onto the outdoor device, in response to the stored water being detected at the first water level of the water tank by the first water level sensor and the stored water being detected at the second water level of the water tank by the second water level sensor, and
  - with the stored water being sprayed onto the outdoor device:
    - stop spraying the stored water onto the outdoor device, in response to the stored water not being detected at the second water level of the water tank by the second water level sensor.

2. The spraying device of claim 1, wherein
- the at least one instruction further includes to:
  - obtain a value of a supply current supplied to the outdoor device, and
  - the start of spraying starts spraying based on the value of the supply current being greater than or equal to a first reference current value and based on the stored water being detected at the first water level of the water tank by the first water level sensor and the stored water being detected at the second water level of the water tank by the second water level sensor.

3. The spraying device of claim 2, wherein
- the at least one instruction further includes to stop spraying based on the value of the supply current being less than the first reference current value.

4. The spraying device of claim 2, further comprising:
- a drain valve configured to drain the stored water from the water tank,
- wherein the at least one instruction further includes to:
  - open the drain valve to drain the stored water from the water tank based on a reference drainage time having elapsed since the stopping of the spraying.

5. The spraying device of claim 4, wherein
- the at least one instruction further includes to:
  - close the drain valve based on a reference standby time having elapsed since the opening the drain valve and the value of the supply current being greater than or equal to a second reference current value, and
  - the second reference current value corresponds to the value of the supply current during an initial operation of the air conditioner in which the air conditioner starts operating.

6. The spraying device of claim 2, further comprising:
- a current sensor configured to measure the value of the supply current supplied to the outdoor device,
- wherein the obtained value corresponds to the value of the supply current measured by the current sensor.

7. The spraying device of claim 2,
- wherein the value of the supply current is obtained from the outdoor device.

8. The spraying device of claim 1, further comprising:
- a water supply valve configured to open and close, respectively, a supply of the stored water to the nozzle,
- wherein the at least one instruction further includes to:
  - open the water supply valve to start the spraying of the stored water onto the outdoor device, and
  - close the water supply valve to stop the spraying of the stored water onto the outdoor device.

9. The spraying device of claim 8, further comprising: an air pump configured to inject air into the nozzle,
- wherein the at least one instruction further includes to:
  - with the water supply valve being open:
    - control the air pump to inject air into the nozzle.

10. The spraying device of claim 9, wherein
- the at least one instruction further includes to:
  - with the water supply valve being closed:
    - control the air pump to inject air into the nozzle for a first reference time after the water supply valve is closed, and
    - when the first reference time has elapsed since the water supply valve is closed, control the air pump to stop injecting air into the nozzle.

11. The spraying device of claim 1, further comprising:
- an indoor device of the air conditioner including a pipe configured to transport condensate water that is condensed by the indoor device, wherein
- the water tank includes a water inlet connected to the pipe and configured to receive the condensate water transported from the indoor device through the pipe.

12. The spraying device of claim 1, further comprising:

a step motor configured to rotate the nozzle, wherein the at least one instruction further includes to: control the step motor to rotate the nozzle.

13. The spraying device of claim 1, wherein the water tank includes a first stage and a second stage having a lower surface lower than a first stage lower surface and a drain hole configured to drain the stored water into the nozzle, the second stage includes a narrower and deeper shape than the first stage, the first water level sensor is configured to detect the stored water at the first water level of the water tank in the first stage, and the second water level sensor is configured to detect the stored water at the second water level of the water tank in the second stage.

14. A method of controlling a spraying device for spraying water onto an outdoor device of an air conditioner, the method comprising:

detecting stored water at a first water level of a water tank of the spraying device by using a first water level sensor;

detecting the stored water at a second water level of the water tank that is lower than the first water level of the water tank by using a second water level sensor; and with the stored water not being sprayed onto the outdoor device:

starting spraying the stored water onto the outdoor device, in response to the stored water being detected at the first water level of the water tank by the first water level sensor and the stored water being detected at the second water level of the water tank by the second water level sensor, and with the stored water being sprayed onto the outdoor device:

stopping spraying the stored water onto the outdoor device, in response to the stored water not being detected at the second water level of the water tank by the second water level sensor.

15. The method of claim 14, further comprising:

obtaining a value of a supply current supplied to the outdoor device, wherein the starting spraying includes starting spraying based on the value of the supply current being greater than or equal to a first reference current value and based on the stored water being detected at the first water level of the water tank by the first water level sensor and the stored water being detected at the second water level of the water tank by the second water level sensor.

16. The method of claim 15, wherein the stopping spraying includes stopping spraying based on the value of the supply current being less than the first reference current value.

17. The method of claim 15, further comprising: opening a drain valve of the spraying device to drain the stored water from the water tank, based on a reference drainage time having elapsed since the stopping spraying.

18. The method of claim 17, further comprising:

closing the drain valve of the spraying device to stop draining the stored water from the water tank, based on a reference standby time having elapsed since the opening the drain valve and the value of the supply current being greater than or equal to a second reference current value, wherein the second reference current value corresponds to the value of the supply current during an initial operation of the air conditioner in which the air conditioner starts operating.

19. The method of claim 15, further comprising:

opening a water supply valve, which is configured to open and close to open and close, respectively, a supply of stored water to a nozzle configured spray the stored water onto the outdoor device, to start the spraying of the stored water onto the outdoor device; and closing the water supply valve to stop the spraying of the stored water onto the outdoor device.

20. A computer-readable recording medium having recorded thereon a program for performing the method of claim 14, on a computer.

* * * * *